US011339045B2

(12) United States Patent
Conway et al.

(10) Patent No.: US 11,339,045 B2
(45) Date of Patent: May 24, 2022

(54) FLAVOR AND ADDITIVE DELIVERY SYSTEMS AND METHODS FOR BEVERAGE DISPENSERS

(71) Applicant: Elkay Manufacturing Company, Downers Grove, IL (US)

(72) Inventors: John Conway, Chicago, IL (US); Cesar Ramirez, Riverside, IL (US); Erik Lynch, Downers Grove, IL (US); Bart Peeters, Bartlett, IL (US); Robert Zudic, Chicago, IL (US); Marilyn Bombard, Arlington Heights, IL (US); Samuel Goodrow, Chicago, IL (US)

(73) Assignee: Elkay Manufacturing Company, Downers Grove, IL (US)

( * ) Notice: Subject to any disclaimer, the term of this patent is extended or adjusted under 35 U.S.C. 154(b) by 0 days.

(21) Appl. No.: 17/244,516

(22) Filed: Apr. 29, 2021

(65) Prior Publication Data

US 2022/0017347 A1 Jan. 20, 2022

Related U.S. Application Data

(60) Provisional application No. 63/094,167, filed on Oct. 20, 2020.

(51) Int. Cl.
*B67D 7/78* (2010.01)
*B67D 1/00* (2006.01)
(Continued)

(52) U.S. Cl.
CPC ..... *B67D 1/0021* (2013.01); *B05B 7/061* (2013.01); *B67D 1/0801* (2013.01); *B67D 2001/0095* (2013.01)

(58) Field of Classification Search
CPC ..... B67D 1/0021; B67D 1/0801; B67D 2001/0095; B05B 7/061
See application file for complete search history.

(56) References Cited

U.S. PATENT DOCUMENTS 1,261,986 A 4/1918 White
4,392,588 A * 7/1983 Scalera ..... G07F 13/10 222/129.4
(Continued)

FOREIGN PATENT DOCUMENTS

EP 1876137 A1 1/2008
GB 2507029 A 4/2014
(Continued)

*Primary Examiner* — Vishal Pancholi
*Assistant Examiner* — Bob Zadeh
(74) *Attorney, Agent, or Firm* — Neal, Gerber & Eisenberg LLP; Tanvi Patel; Nawshaba M. Siddiquee

(57) ABSTRACT

Flavor and additive delivery systems and methods for beverage dispensers are disclosed. An example manifold of a beverage dispenser includes a base defining a base cavity and configured to extend through an opening defined by an outer wall. The manifold includes a first housing coupled to the base and defining a housing cavity. The base cavity and the housing cavity are adjacent to each other to form a chamber. The manifold includes a body coupled to the first housing and defining a body cavity and angled apertures. The manifold includes an insert housing that is coupled to the body and extends at least partially through the body cavity. The manifold includes an insert housed within the insert housing and defining a water outlet for spraying water downward into the chamber. The angled apertures are configured to receive nozzles that extend at least partially into the chamber at the predefined angle.

20 Claims, 21 Drawing Sheets

(51) Int. Cl.
*B05B 7/06* (2006.01)
*B67D 1/08* (2006.01)

(56) References Cited

U.S. PATENT DOCUMENTS 5,190,188 A * 3/1993 Credle, Jr. ..... B67D 1/0021 222/1
5,203,474 A * 4/1993 Haynes ..... B67D 1/005 222/129.1
5,415,326 A * 5/1995 Durham ..... B67D 1/0044 222/129.1
5,526,959 A * 6/1996 Green ..... B67D 1/0051 222/129.4
5,803,320 A * 9/1998 Cutting ..... B67D 1/0036 222/129.1
5,992,685 A 11/1999 Credle
6,022,201 A 2/2000 Kasmer
6,098,842 A * 8/2000 Schroeder ..... B67D 1/0051 222/1
6,234,354 B1 * 5/2001 Phillips ..... B67D 1/0021 222/129.1
6,253,963 B1 * 7/2001 Tachibana ..... B67D 1/005 222/129.1
6,321,938 B1 11/2001 Edwards et al.
6,547,100 B2 4/2003 Phillips et al.
6,669,057 B2 12/2003 Saidman et al.
6,676,029 B2 1/2004 Mitchell
6,698,333 B2 3/2004 Halliday et al.
6,751,525 B1 6/2004 Crisp
6,766,656 B1 7/2004 Crisp et al.
6,799,085 B1 9/2004 Crisp
7,032,818 B2 4/2006 Thomas et al.
7,097,074 B2 8/2006 Halliday et al.
7,147,131 B2 12/2006 Sher et al.
7,156,261 B2 1/2007 Saidman et al.
7,213,506 B2 5/2007 Halliday et al.
7,219,598 B2 5/2007 Halliday et al.
7,231,869 B2 6/2007 Halliday et al.
7,243,598 B2 7/2007 Halliday et al.
7,255,039 B2 8/2007 Halliday et al.
7,258,276 B2 8/2007 Linton et al.
7,287,461 B2 10/2007 Halliday et al.
7,293,705 B2 11/2007 Linton et al.
7,308,851 B2 12/2007 Halliday
7,316,178 B2 1/2008 Halliday et al.
7,322,277 B2 1/2008 Halliday et al.
7,328,651 B2 2/2008 Halliday et al.
7,340,990 B2 3/2008 Halliday et al.
7,383,966 B2 6/2008 Ziesel
7,387,239 B2 6/2008 Thomas et al.
7,389,895 B2 6/2008 Crisp
7,416,097 B2 8/2008 Crisp et al.
7,418,899 B2 9/2008 Halliday et al.
7,418,969 B1 9/2008 Crisp
7,419,073 B2 9/2008 Crisp et al.
7,487,887 B2 2/2009 Ziesel
7,490,054 B2 2/2009 Reade et al.
7,533,603 B2 5/2009 Halliday et al.
7,533,604 B2 5/2009 Halliday et al.
7,578,419 B2 8/2009 Greenwald et al.
7,591,399 B2 9/2009 Hortin et al.
7,591,421 B2 9/2009 Linton et al.
7,592,027 B2 9/2009 Halliday et al.
7,594,525 B2 9/2009 Girard et al.
7,607,385 B2 10/2009 Halliday et al.
7,614,524 B2 11/2009 Girard et al.
7,640,843 B2 1/2010 Halliday et al.
7,641,865 B2 1/2010 Tonkovich et al.
7,651,015 B2 1/2010 Girard et al.
7,661,591 B2 2/2010 Dearing et al.
7,735,732 B2 6/2010 Linton et al.
7,743,946 B2 6/2010 Edwards et al.
7,757,896 B2 7/2010 Carpenter et al.
7,784,689 B2 8/2010 Linton et al.
7,791,479 B2 9/2010 Dearing et al.
7,798,367 B2 9/2010 Minard et al.
7,828,020 B2 11/2010 Girard et al.
7,836,922 B2 11/2010 Poole et al.
7,866,509 B2 * 1/2011 Ziesel ..... B67D 1/0046 222/145.1
7,890,209 B2 2/2011 Knepler
7,896,202 B2 3/2011 Greenwald et al.
7,913,879 B2 3/2011 Carpenter et al.
7,938,326 B2 5/2011 Dearing et al.
7,942,321 B2 5/2011 Linton et al.
7,950,423 B2 5/2011 Poole et al.
7,958,916 B2 6/2011 Poole et al.
7,967,199 B2 6/2011 Linton et al.
8,006,866 B2 8/2011 Minard et al.
8,025,082 B2 9/2011 Poole et al.
8,025,184 B2 9/2011 Minard et al.
8,025,228 B2 9/2011 Dearing et al.
8,067,031 B2 11/2011 Daniloff et al.
8,083,100 B2 12/2011 Minard et al.
8,091,735 B2 1/2012 Girard et al.
8,103,378 B2 1/2012 Crisp
8,113,425 B2 2/2012 Dearing et al.
8,162,176 B2 4/2012 Rudick
8,162,181 B2 4/2012 Carpenter et al.
8,168,247 B2 5/2012 Halliday et al.
8,210,396 B2 7/2012 Girard et al.
8,220,505 B2 7/2012 Poole et al.
8,230,887 B2 7/2012 Poole et al.
8,231,053 B2 7/2012 Linton et al.
8,290,615 B2 10/2012 Crisp et al.
8,290,616 B2 10/2012 Crisp
8,303,973 B2 11/2012 Daniloff et al.
8,424,719 B2 4/2013 Minard et al.
8,434,642 B2 5/2013 Rudick
8,453,879 B2 6/2013 Carpenter et al.
8,460,708 B2 6/2013 Daniloff et al.
8,481,073 B2 7/2013 Daniloff et al.
8,548,624 B2 10/2013 Crisp
8,565,916 B2 10/2013 Zhang et al.
8,584,900 B2 11/2013 Metropulos et al.
8,640,931 B2 2/2014 Okeefe et al.
8,651,333 B2 2/2014 Metropulos et al.
8,689,677 B2 4/2014 Minard et al.
8,739,840 B2 6/2014 Mattos et al.
8,746,507 B2 6/2014 Metropulos et al.
8,757,222 B2 6/2014 Rudick et al.
8,757,227 B2 6/2014 Girard et al.
8,757,434 B2 6/2014 Roekens et al.
8,768,524 B2 7/2014 Hammonds et al.
8,800,820 B2 8/2014 Girard et al.
8,803,009 B2 8/2014 Poole et al.
8,807,393 B2 8/2014 Carpenter et al.
8,814,000 B2 8/2014 Rudick
8,852,659 B2 10/2014 Halliday et al.
8,857,666 B2 10/2014 Okeefe
8,905,267 B2 12/2014 Minard et al.
8,960,500 B2 2/2015 Van Opstal et al.
8,973,786 B2 3/2015 Minard et al.
8,985,395 B2 3/2015 Tansey
9,067,775 B2 6/2015 Mattos et al.
9,090,446 B2 7/2015 Crisp
9,090,447 B2 7/2015 Crisp
9,090,449 B2 7/2015 Crisp
9,102,508 B2 8/2015 Okeefe et al.
9,126,738 B2 9/2015 Boggs et al.
9,155,417 B2 10/2015 Girard et al.
9,245,402 B2 1/2016 Green et al.
9,371,219 B2 6/2016 Metropulos et al.
9,376,308 B2 6/2016 Petrangeli et al.
9,399,570 B2 7/2016 Van Haperen et al.
9,406,187 B2 8/2016 Hammonds et al.
9,415,991 B2 8/2016 Green
9,415,992 B2 8/2016 Ryan et al.
9,434,596 B2 9/2016 Carpenter et al.
9,451,847 B2 9/2016 Halliday et al.
9,508,211 B2 11/2016 Roekens et al.
9,527,715 B2 12/2016 Boggs et al.
9,536,236 B2 1/2017 Hay
RE46,326 E 2/2017 Dearing et al.

(56) References Cited

U.S. PATENT DOCUMENTS 9,576,419 B2 2/2017 Carpentier et al.
9,580,291 B2 2/2017 Van Haperen et al.
9,652,756 B2 5/2017 Knecht et al.
9,652,922 B1 5/2017 Schuck
9,656,849 B2 5/2017 Hawken
9,670,047 B2 6/2017 Carpenter et al.
9,691,212 B2 6/2017 Green et al.
9,701,527 B2 7/2017 Tansey
9,761,078 B1 9/2017 Schuck
9,772,216 B2 9/2017 Poole et al.
9,776,848 B2 10/2017 Metropulos et al.
9,783,403 B2 10/2017 Tansey
9,809,437 B2 11/2017 Tansey
9,821,992 B2 11/2017 Rudick et al.
9,833,084 B2 12/2017 Roekens et al.
9,840,406 B2 12/2017 Santy et al.
9,850,118 B2 12/2017 Deo et al.
9,957,145 B2 5/2018 Cohen et al.
9,994,388 B2 6/2018 Halliday et al.
9,994,437 B2 6/2018 Showalter
10,029,904 B2 7/2018 Carpenter et al.
10,037,645 B2 7/2018 Roekens et al.
10,040,042 B2 8/2018 Showalter
10,046,959 B2 8/2018 Rudick
10,083,430 B2 9/2018 Hay
10,163,293 B2 12/2018 Hammonds et al.
10,176,469 B2 1/2019 Mao
10,233,003 B2 3/2019 Deraedt et al.
10,259,699 B2 4/2019 Showalter
10,280,060 B2 5/2019 Van Opstal et al.
10,384,922 B2 8/2019 Carpenter et al.
10,388,101 B2 8/2019 Carpentier et al.
RE47,599 E 9/2019 Dearing et al.
10,399,841 B2 9/2019 Metropulos et al.
10,442,611 B2 10/2019 Halliday et al.
10,482,704 B2 11/2019 Locke et al.
10,501,304 B2 12/2019 Jangbarwala et al.
10,513,424 B2 12/2019 Tansey
10,526,122 B2 1/2020 Deraedt et al.
10,544,028 B2 1/2020 Guy et al.
10,570,004 B2 2/2020 Gatipon
10,577,234 B2 3/2020 Jangbarwala et al.
10,620,034 B2 4/2020 Poole et al.
10,647,563 B2 5/2020 Showalter
10,647,564 B2 5/2020 Showalter
10,676,273 B2 6/2020 Halliday et al.
2002/0175181 A1 11/2002 Schroeder et al.
2003/0097314 A1 5/2003 Crisp et al.
2004/0040983 A1 3/2004 Ziesel
2004/0112917 A1 6/2004 Groesbeck
2004/0245287 A1 12/2004 Fox
2005/0121466 A1 6/2005 Sher et al.
2005/0133420 A1 6/2005 Rinker et al.
2005/0258082 A1 11/2005 Lund et al.
2006/0051228 A1 3/2006 Hayes-Pankhurst et al.
2007/0114244 A1 5/2007 Gatipon et al.
2007/0131711 A1 6/2007 Minard et al.
2007/0205219 A1 9/2007 Ziesel et al.
2007/0205220 A1 9/2007 Rudick et al.
2007/0205221 A1 9/2007 Carpenter et al.
2009/0032609 A1 2/2009 Ziesel
2009/0134075 A1 5/2009 Underwood
2009/0230149 A1* 9/2009 Smeller ..... B67D 1/0024 222/145.5
2009/0236361 A1 9/2009 Doelman et al.
2010/0147414 A1 6/2010 Nighy et al.
2011/0017776 A1 1/2011 Metropulos et al.
2012/0034122 A1 2/2012 Hayes-pankhurst et al.
2012/0035761 A1 2/2012 Tilton et al.
2012/0046785 A1 2/2012 Deo et al.
2012/0111887 A1 5/2012 Smeller et al.
2012/0240780 A1 9/2012 Delbreil et al.
2012/0240781 A1 9/2012 Delbreil et al.
2012/0285992 A1 11/2012 Ciavarella et al.
2012/0325844 A1 12/2012 Quartarone et al.
2013/0042941 A1 2/2013 Van et al.
2013/0047864 A1 2/2013 Holman et al.
2013/0062366 A1 3/2013 Tansey
2014/0020566 A1 1/2014 Stieger
2014/0114469 A1 4/2014 Givens et al.
2014/0255164 A1 9/2014 Hayes-pankhurst et al.
2014/0348684 A1 11/2014 Hayes-pankhurst et al.
2015/0027315 A1 1/2015 Lüssi et al.
2015/0069087 A1 3/2015 Brown
2015/0110763 A1 4/2015 Leach
2015/0144650 A1 5/2015 Kline et al.
2015/0260195 A1 9/2015 Hayes-pankhurst et al.
2015/0315006 A1 11/2015 Ziesel
2015/0375984 A1 12/2015 Arcand
2016/0009539 A1 1/2016 Jersey et al.
2016/0010634 A1 1/2016 Hayes-pankhurst et al.
2016/0010643 A1 1/2016 Hayes-pankhurst
2016/0010644 A1 1/2016 Hayes-pankhurst et al.
2016/0023879 A1 1/2016 Walker
2016/0069238 A1 3/2016 Brück et al.
2016/0229675 A1 8/2016 Popov et al.
2016/0297666 A1 10/2016 Guy et al.
2016/0325980 A1 11/2016 Sawhney et al.
2017/0088410 A1 3/2017 Wing et al.
2017/0099980 A1 4/2017 Haidar et al.
2017/0236358 A1 8/2017 Carpenter et al.
2017/0313568 A1 11/2017 Kelly et al.
2017/0320719 A1 11/2017 Zemko et al.
2018/0186619 A1 7/2018 Jangbarwala et al.
2018/0186621 A1 7/2018 Jangbarwala et al.
2018/0327243 A1 11/2018 Rider et al.
2018/0365668 A1 12/2018 Hay
2019/0039873 A1* 2/2019 Aslam ..... B67D 1/005
2019/0236890 A1 8/2019 Dubey
2019/0367348 A1 12/2019 Carpenter et al.
2019/0389714 A1 12/2019 Sonnichsen et al.
2020/0029725 A1 1/2020 Wantland et al.
2020/0097897 A1 3/2020 Li
2020/0140253 A1 5/2020 Showalter

FOREIGN PATENT DOCUMENTS

WO 2016146771 A1 9/2016
WO 2016169778 A1 10/2016
WO 2017019880 A1 2/2017
WO 2017137434 A1 8/2017
WO 2017160193 A1 9/2017
WO 2017211890 A1 12/2017

* cited by examiner

FLAVOR AND ADDITIVE DELIVERY SYSTEMS AND METHODS FOR BEVERAGE DISPENSERS

CROSS-REFERENCE TO RELATED APPLICATION

This application claims the benefit of U.S. Provisional Pat. App. No. 63/094,167, which was filed on Oct. 20, 2020 and is incorporated by reference herein in its entirety.

TECHNICAL FIELD

The present disclosure generally relates to a beverage dispenser and, more specifically, to flavor and additive delivery systems and methods for fluid dispensers.

BACKGROUND

Beverage dispensing machines are prevalent within restaurants and/or other establishments within the food industry. Typically, a beverage dispensing machine is capable of dispensing a number of different beverages upon command. For instance, a beverage dispensing machine may include a first button for a first beverage, a second button for a second beverage, a third button for a third beverage, etc. Oftentimes, each of the beverages requires different ratios of different flavors and/or additives to be added to a stream of water. In turn, a beverage dispensing machine typically stores a relatively large number of different flavors and/or additives for mixing with water in order to dispense the various beverages.

In some instances, maintenance time and/or costs associated with a beverage dispensing machine may be significant. For instance, a beverage dispensing machine may need to be serviced if flavor(s) and/or additive(s) for one or more of the selectable beverages runs out within the machine. A beverage dispensing machine may need to be recalibrated if a dispensed ratio between the water and one or more of flavor(s) and/or additive(s) does not equal a desired ratio. Additionally, components of a beverage dispensing machine may need to be cleaned regularly due to the mixing of various different flavor(s) and/or additive(s) within the machine. Oftentimes, if a beverage dispensing machine is not serviced regularly, one or more of the selectable beverage may be unavailable at any given time.

SUMMARY

Example embodiments are shown for a flavor and additive delivery system for a fluid dispenser. The present disclosure summarizes aspects of the embodiments of this application. The disclosure should not be used to limit claims defining this application. Other implementations are contemplated in accordance with the techniques described herein, as will be apparent to one having ordinary skill in the art upon examination of the following drawings and detailed description, and these implementations are intended to be within the scope of this application.

An example manifold of a beverage dispenser for dispensing a beverage into a container is disclosed herein. The example manifold includes a base defining a base cavity and configured to extend through an opening defined by an outer wall of the beverage dispenser. The example manifold includes a first housing coupled to the base and defining a housing cavity. The base cavity and the housing cavity are adjacent to each other to form a chamber. The example manifold includes a body coupled to the first housing and defining a body cavity and angled apertures. The angled apertures are spaced radially outward from the body cavity and oriented radially inward at a predefined angle. The example manifold includes an insert housing that is coupled to the body and extends at least partially through the body cavity. The insert housing defines a water inlet. The example manifold includes an insert housed within the insert housing and defining a water outlet configured to spray a water stream vertically downward into the chamber. The angled apertures are configured to receive nozzles that extend at least partially into the chamber at the predefined angle relative to a vertical axis such that flavor or additive emitted by one or more of the nozzles is injected into the water stream at a mid-air injection point within the chamber.

In some examples, the mid-air injection point within the chamber is spaced apart from surfaces of the base, the first housing, the body, the insert housing, and the insert to reduce how frequently the manifold is to be cleaned.

In some examples, the base, the first housing, the body, the insert housing, and the insert are configured to decouple from each other without tooling to facilitate cleaning of the manifold. In some such examples, the base includes a circumferential lip configured to rest on the outer wall of the beverage dispenser. In some such examples, the first housing includes first clips for fastening the first housing to the outer wall of the beverage dispenser. In some such examples, the body further defines clip openings and the first housing includes clips that extend through the clip openings to couple the body to the first housing. In some such examples, the insert is threadably coupled to the insert housing. In some such examples, the insert housing includes clips openings and the body includes clips that extend through the clip openings to couple the insert housing to the body.

In some examples, the insert defines a plurality of passageways that form the water outlet. The plurality of the passageways create a uniform water flow with reduced pressure to facilitate subsequent mixture with flavor or additive emitted by the nozzles.

In some examples, the insert housing includes an upper portion and a lower portion. In some such examples, the upper portion defines the water inlet. In some such examples, the lower portion defines an insert cavity in which the insert is housed. In some such examples, the lower portion includes inner threads, the insert includes outer threads, and the inner threads are configured to threadably receive the outer threads to couple the insert to the insert housing.

An example method for operating and maintaining a manifold of a beverage dispenser that dispenses a beverage into a container is disclosed herein. The example method includes positioning a base to extend through an opening defined by an outer wall of the beverage dispenser. The base defines a base cavity. The example method includes coupling a first housing to the base such that a housing cavity defined by the housing cavity is positioned adjacent to the base cavity to form a chamber. The example method includes coupling a body to the first housing. The body defines a body cavity and angled apertures. The angled apertures are spaced radially outward from the body cavity and oriented radially inward at a predefined angle. The example method includes housing an insert within an insert housing. The insert defines a water outlet, and the insert housing defines a water inlet. The example method includes positioning the insert housing at least partially through the body cavity, coupling the insert housing to the body such that the water outlet is configured to spray a water stream downward into the chamber, extending nozzles through the angled apertures such that the nozzles extend at least partially into the chamber at the predefined angle relative to a vertical axis, and injecting flavor or additive via one or more of the nozzles into the water stream at a mid-air injection point within the chamber.

Some examples further comprise decoupling the base, the first housing, the body, the insert housing, and the insert from each other without tooling and cleaning the base, the first housing, the body, the insert housing, and the insert of the manifold.

Some examples further comprise resting a circumferential lip of the base on the outer wall of the beverage dispenser.

Some examples further comprise fastening the first housing to the outer wall of the beverage dispenser via clips of the first housing.

In some examples, coupling the body to the first housing includes extending clips through clip openings.

Some examples further comprise threadably coupling the insert to the insert housing.

In some examples, coupling the insert housing to the body includes extending clips through clip openings.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
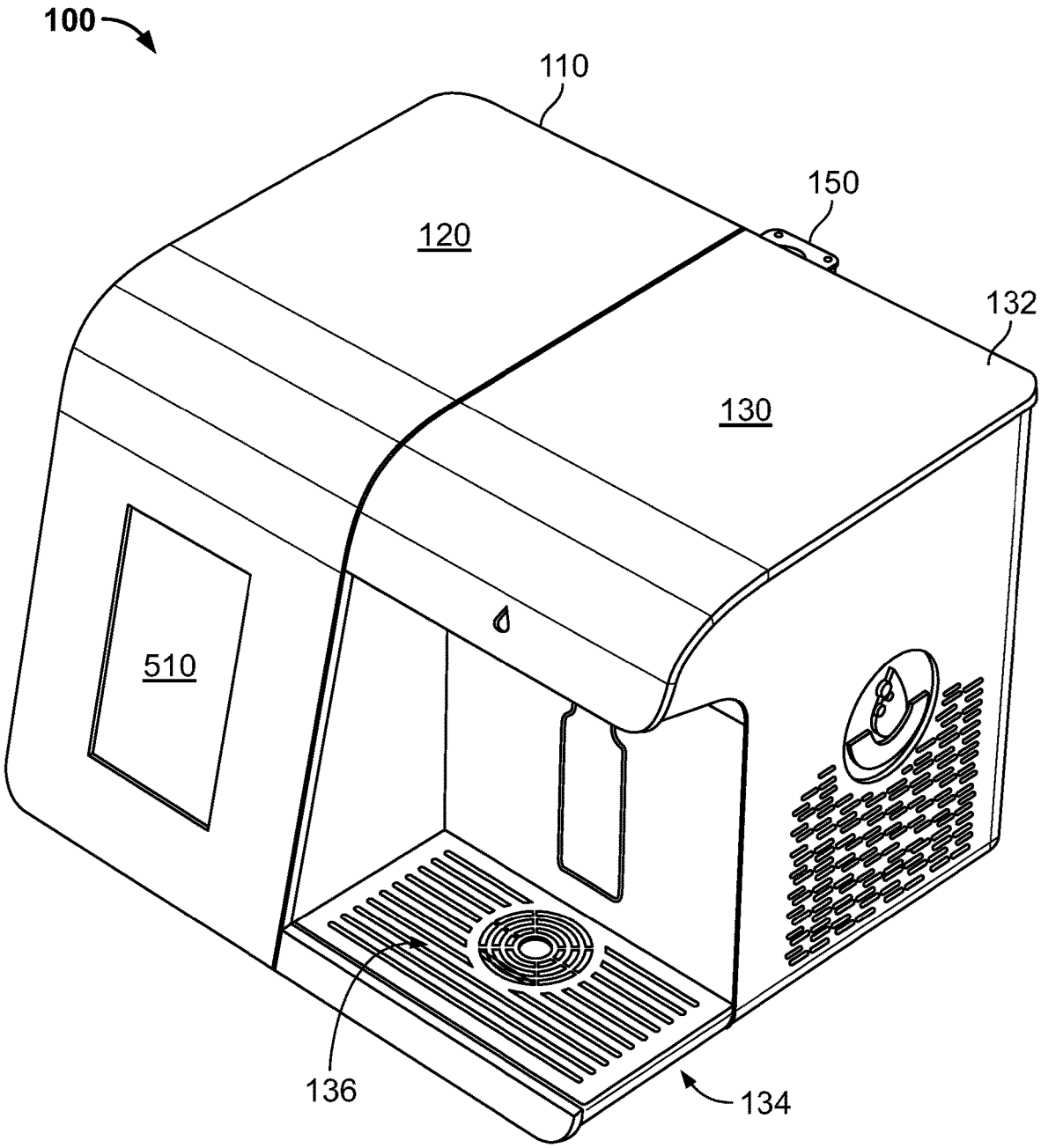
FIG. 1 illustrates an example beverage dispenser in accordance with the teachings herein.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

An example additive delivery system disclosed herein is automated and configured to monitor, control, and/or report an operating status of one or more beverage dispensers. The automated delivery system is configured to (1) maintain a stock of the flavor/additives and/or (2) adjust the dispensing of water and/or flavor/additives in order to ensure that each selectable beverage is available and consistently dispensed. Additionally, an example beverage dispenser disclosed herein includes components, such as a manifold and flavor pouches, that are configured to be washed, replaced, and/or otherwise serviced without tools and/or specialized training in order to reduce maintenance time and/or costs.

Figure 2:
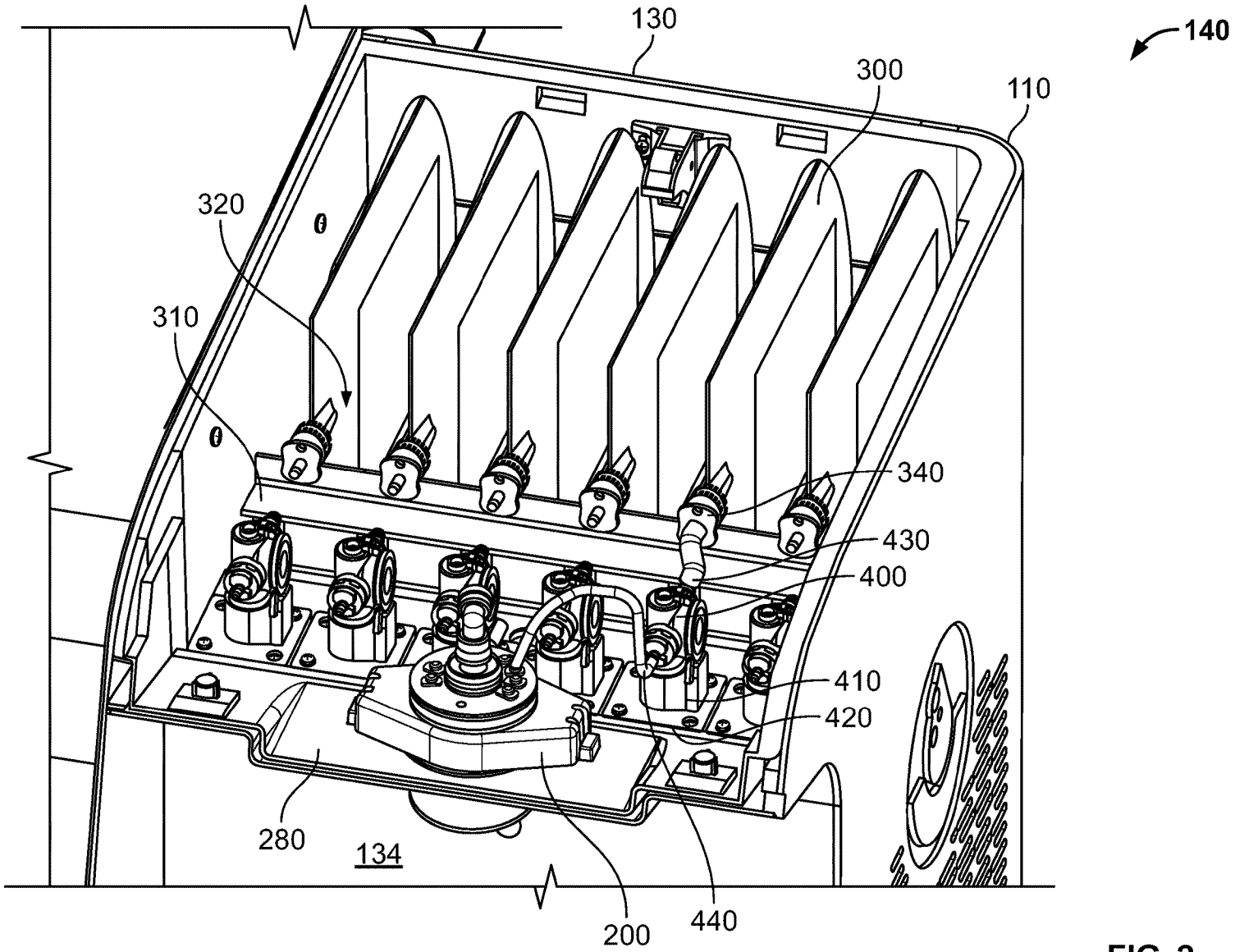
FIG. 2 illustrates an interior of the beverage dispenser of FIG. 1.

Turning to the figures, FIGS. 1-2 illustrates an example beverage dispenser 100 (also referred to as a "beverage dispensing machine") in accordance with the teachings herein. More specifically, FIG. 1 depicts an exterior of the beverage dispenser 100, and FIG. 2 depicts an interior cavity 140 of the beverage dispenser 100 in which components of the beverage dispenser 100 are housed.

As illustrated in FIG. 1, the beverage dispenser 100 includes a housing 110 configured to securely enclose components of the beverage dispenser 100. The beverage dispenser 100 includes a dispensing area 134 at which beverage is dispensed into a container. The beverage dispenser 100 also includes a user interface 510 that is configured to enable a user to select a beverage to dispense. As disclosed below in greater detail, the user interface 510 of the illustrated example, includes a touchscreen. Additionally or alternatively, the user interface 510 may include one or more mechanical levers, mechanical buttons, touchpads, etc. The beverage dispenser 100 of FIG. 1 also includes a bracket 150 that is configured to house a water filter. Additionally, a pressurized chiller unit is disposed within the housing 110 of the beverage dispenser 100. In other examples, the pressurized chiller unit is configured to be positioned outside of the housing 110 (e.g., below a counter, in an accessory housing, etc.). The pressurized chiller unit is configured to provide pressurized water at a chilled temperature that is used by the beverage dispenser 100 to create a selected beverage.

In the illustrated example, the housing 110 includes a chiller portion 120 and a fluid control portion 130. For example, the chiller portion 120 is configured to house the pressurized chiller unit. The control portion 130 is configured to house electronic components and one or more fluid control components of the beverage dispenser 100. For example, the control portion 130 includes a fluids portion (e.g., an upper portion) that is configured to house the fluid control components of the beverage dispenser 100 and an electronics portion (e.g., a lower portion) that is configured to house electronic components of the beverage dispenser 100. The electronic components of the beverage dispenser 100 include the user interface 510, a processor 500 and memory of FIGS. 3-4, circuit boards, etc. The fluid control components are configured to dispense fluids for the creation and dispensing of a selected beverage. For example, the control portion 130 defines the dispensing area 134 of the beverage dispenser 100. The control portion 130 also includes a tray 136 located near the bottom of the dispensing area 134. The tray 136 is configured to receive a beverage container positioned within the dispensing area 134 while the beverage dispenser 100 is dispensing a beverage into the beverage container. The dispensing area 134 also includes a cover 132 that is configured to enable a designated person to access and service fluid components housed within the control portion 130 of the housing 110 without tools and/or specialized training.

FIG. 2 depicts the interior cavity 140 of the control portion 130 of the housing 110 of the beverage dispenser 100. As illustrated in FIG. 2, a rack 310 of the beverage dispenser 100 is housed in the interior cavity 140. The rack 310 defines a plurality of slots 320 in which a plurality of pouches 300 are to be housed. Each of the pouches 300 is configured to contain a flavor and/or additive (e.g., a syrup, a liquid including citric acid, etc.) for one or more beverages capable of being dispensed by the beverage dispenser 100. The rack 310 includes one or more side walls or barriers that divide the pouches 300 from each other. In the illustrated example, the rack 310 also includes a bottom surface on which the pouches 300 are capable of resting. In other examples, the pouches 300 hang from respective hooks within slots 320.

As illustrated in FIG. 2, the beverage dispenser 100 also includes a manifold 200 housed within the interior cavity 140. As detailed below in greater detail, the manifold 200 is configured to blend the water of the pressurized water unit with the flavor/additive of one or more of the pouches 300 to create a beverage. The manifold 200 is secured to an outer wall 280 of the beverage dispenser 100 above the dispensing area 134 to enable the manifold to dispense a beverage into a container positioned within the dispensing area 134.

The beverage dispenser 100 also includes one or more pumps 400 that are housed within the interior cavity 140. In the illustrated example, each of the pumps 400 is secured in place within the interior cavity 140 via a respective pump housing 410 coupled to a chassis 420. Each of the pumps 400 is configured to fluidly connect to a respective one of flavor nozzles 260 housed by the manifold 200 and a respective one of the pouches 300 to control the flow of flavor/additive from the pouch 300 to the flavor nozzles 260. Additionally, each of the pumps 400 is configured to fluidly connect to a probe 340 of a respective one of the pouches 300 via tubing 430.

Figure 3:
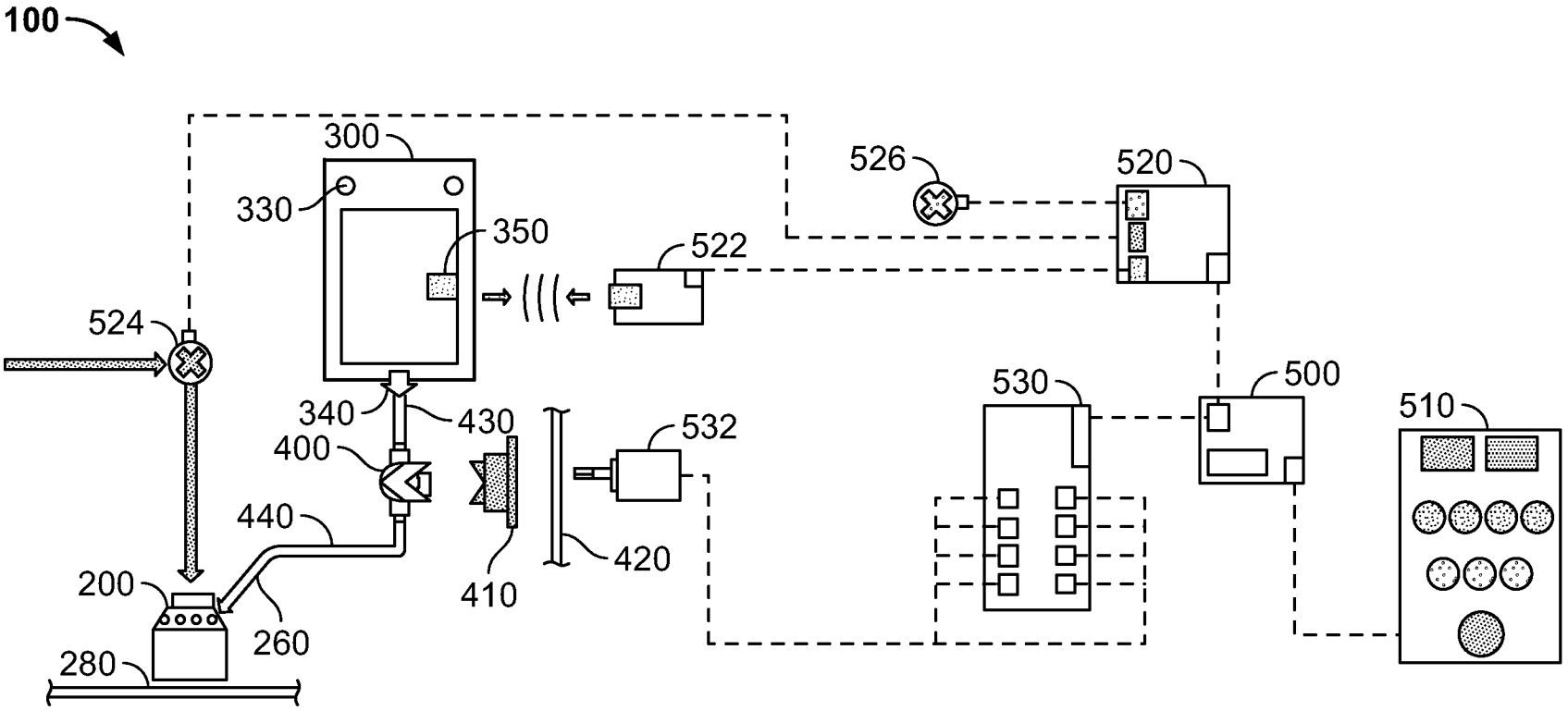
FIG. 3 depicts fluid and electrical schematics for operation of the beverage dispenser of FIG. 1.

FIG. 3 depicts fluid and electrical schematics for operation of the beverage dispenser 100. As disclosed below in greater detail, the manifold 200 is configured to receive a stream of water, for example, from a pressurized chiller unit. Additionally, the manifold 200 is configured to direct the stream of water in a substantially vertical downward direction into a beverage container. Additionally, the manifold 200 is secured adjacent to an opening of the outer wall 280 of the beverage dispenser 100 to enable the manifold 200 to dispense beverages into containers.

Each of the pouches 300 is configured to contain a flavor and/or additive (e.g., citric acid) that is to be selectively injected into the stream of water via the manifold 200 to form the beverage dispensed by the beverage dispenser 100. In some examples, citric acid and other additives are kept in separate ones of the pouches 300 in order to increase the shelf life of the flavor contained within the respective pouches 300. In the illustrated example, the flavor/additive of each of the pouches 300 is emitted through the respective probe 340 to the flavor nozzles 260 housed by the manifold 200. In the illustrated example of FIG. 3, each of the pouches 300 includes one or more holes 330. Each of the holes 330 is configured to receive a hook from which the respective pouch 300 is to hang (e.g., similar to how an IV bag is hung) in position within one of the slots 320 of the beverage dispenser 100.

Such hanging and/or slot configurations for securing the pouches 300 within the beverage dispenser 100 enables the pouches 300 to be replaced by hand without tools and/or special training. Moreover, as disclosed below in greater detail, the manifold 200 enables the pouches 300 to be replaced without also cleaning the water line and/or the corresponding flavor/additive line. To further facilitate maintenance the pouches 300 in some examples are single-use, disposable pouches. As used herein, a "single-use" and/or "disposable" article refers to an article made of plastic and/or other material that was designed to be recycled or thrown away after being used only once for a designated use. For example, a single-use and/or disposable pouch is configured to be fully recycled after the flavor/additive is fully emptied from the pouch.

Each of the pumps 400 is configured to fluidly couple to (1) a respective one of flavor nozzles 260 housed by the manifold 200 and (2) a respective one of the pouches 300 to control the flow of flavor/additive from the pouch 300 to the manifold 200. In the illustrated example, each of the pumps 400 is fluidly connected to a respective one of the pouches 300 via the tubing 430. The probe 340 of the pouch 300 is configured to form a sealed connection between the pouch 300 and the tubing 430. Additionally, each of the pumps 400 is fluidly connected to a respective one of the one or more flavor nozzles 260 (also referred to as "nibs") housed by the manifold 200 via the tubing 440. As disclosed below in greater detail, the flavor nozzles 260 are configured to inject the corresponding flavor/additive at a predefined injection angle (e.g., a 20-degree angle formed between the water stream and the flavor/additive stream) relative to the substantially vertical downward flow of the stream of water to facilitate mixing of the flavor/additive with the water to form a fully-mixed beverage. That is, mixing occurs when the flavor/additive stream(s) intersect with the water stream at the predefined injection angle.

Each of the pumps 400 in the illustrated example is secured in place via a respective one of one or more pump housings 410. Each of the pump housings 410 is secured to a chassis 420 and is configured to receive a respective one of the pumps 400 to secure the respective pump 400 to the chassis 420. Additionally, each of the pump housings 410 is configured to receive a shaft of a respective one of one or more motors 532 for control of the respective pump 400. Each of the pump housings 410 is configured to align the shaft of the respective motor 532 with the respective pump 400 to enable the motor 532 to control operation of the pump 400.

As illustrated in FIG. 3, the beverage dispenser 100 includes electrical components that are configured to monitor and control operation of the fluid flow components of the beverage dispenser 100. The electrical components include a processor 500, a user interface 510, one or more sensors, and one or more motor(s) and/or solenoid valve(s).

The processor 500 is configured to collect input data from the user interface 510 and/or the one or more sensors. The processor 500 is communicatively connected, via a wired and/or wireless connection, to each of the input devices to collect data from those devices. In the illustrated example, the processor 500 is communicatively connected directly to the user interface 510. Further, the processor 500 is communicatively connected to the sensors via a sensor control board 520. That is, the processor 500 is directly connected to the sensor control board 520, and the sensor control board 520 is directly connected to each of the sensors.

The user interface 510 includes digital and/or analog interfaces, such as input devices for receiving input information from and/or output devices to display output information to user(s) and/or operator(s) for control of the beverage dispenser 100. The input devices include, for example, mechanical lever switch(es), mechanical button(s), touchpad(s), a touchscreen, a microphone, etc. The output devices may include light emitting diodes (LEDs), audio speaker(s), a display (e.g., a liquid crystal display (LCD)), a touchscreen, etc. In the illustrated example, user interface 510 includes hardware (e.g., a processor, memory, storage, etc.) and software. As used herein, the term "user interface" refers to hardware with circuitry to provide interface capabilities. A "user interface" may also include firmware that executes on the circuitry. In some examples, the beverage dispenser 100 is configured to communicatively couple (e.g., via a communication module 540 of FIG. 4) to a mobile device (e.g., a smartphone, a wearable, a tablet, etc.) to enable a user to provide input information to and/or receive output information from the beverage dispenser 100 via input and/or output devices of the mobile device. For example, the beverage dispenser is configured to wirelessly communicate (e.g., via Bluetooth®, Wi-Fi®, etc.) to receive input information from and/or present output information to a user of the beverage dispenser 100.

The user interface 510 is configured to receive beverage selections from users of the beverage dispenser 100. For example, the user interface 510 includes a plurality of input devices (e.g., analog and/or digital buttons) to enable users to select from a plurality of different beverages that the beverage dispenser 100 is capable of providing. In some examples, the user interface 510 also includes an input device (e.g., an analog and/or digital button) that causes the beverage dispenser 100 to dispense a selected beverage. In the illustrated example, the user interface 510 also includes one or more output device(s) (e.g., a LEDs, a display, a speaker, etc.) to provide user(s) and/or operator(s) with information regarding the status of the beverage dispenser 100. For example, the output device(s) are configured to alert a user when a selected beverage is currently unavailable (e.g., due to a corresponding one of the pouches 300 being empty). An example output device of the beverage dispenser 100 includes a light source configured to emit light into the dispensing area 134 at different predefined levels of brightness to identify the current status of events and/or modes (e.g., sleep mode, rest mode, dispense mode, post-dispense mode, etc.) throughput the filling process of the beverage dispenser. In some examples, the light source is a light ring that that includes a plurality of LEDs disposed around the manifold 200 and is configured to emit light downwardly into the dispensing area 134 at different predefined levels of brightness.

In the illustrated example, the sensors of the beverage dispenser 100 include one or more pouch sensors 522, a flowrate sensor 524, and an electrical current sensor 526. The flowrate sensor 524 is configured measure a rate at which water flows into, through, and/or out of the manifold 200 of the beverage dispenser 100. The electrical current sensor 526 is configured to monitor an operation status of the water source (e.g., the pressurized chiller unit), for example, by identifying an electrical current consumption signature of the water source and subsequently determining whether there are any anomalies with the functionality of the water source. Additionally or alternatively, the beverage dispenser 100 includes a temperature sensor to monitor the temperature of the water being provided by the water source.

Each of the pouch sensors 522 is configured to detect a pouch tag 350 of a corresponding one of the pouches 300. The pouch tag 350 is a unique identifier, such as a barcode, a serial number, a Quick Response (QR) code, a color code, a radio frequency identification (RFID) tag, a near-field communication (NFC) tag, a magnetic strip, a chip (e.g., similar to that of credit cards), etc., that identifies characteristics of the corresponding pouch 300, such as beverage type, flavor/additive type, initial fill level, designated water ratio for the flavor/additive, installation date and/or time, expiration date, etc. Each of the pouch sensors 522 is a camera, reader, and/or other device that is configured to detect and/or identity a pouch tag 350 of a pouch 300. For example, one or more of the pouch sensors 522 may be a camera configured to detect a QR or color code of a pouch tag 350, an RFID reader to configured to read an RFID tag of a pouch tag 350, an NFC reader to configured to read an NFC tag of a pouch tag 350, etc. Further, in some examples, the beverage dispenser 100 of the illustrated example includes a filter sensor (e.g., a camera, an RFID reader, an NFC reader, etc.) configured to detect and/or read a tag of a water filter for the water obtained from the water source (e.g., the pressurized chiller unit).

Each of the pouch tags 350 of the beverage dispenser 100 of the illustrated example is designated to monitor a respective pouch position of the beverage dispenser 100. Returning to FIG. 2, each of the pouch positions are labeled (e.g., with an alphanumeric label such as 1, 2, 3, 4, 5, 6). Each of the pouch sensors 522 is positioned adjacent to and/or near a respective designated position for one of the pouches 300 to enable the pouch sensor 522 to detect and/or read a pouch tag 350 when a respective pouch 300 is secured in that designated position. For example, if the beverage dispenser 100 includes six of the slots 320 to enable the beverage dispenser 100 to house six of the pouches 300 at a time, the beverage dispenser 100 also includes six of the pouch sensors 522 with each pouch sensor 522 being positioned to monitor a dedicated one of the slots 320. In some examples, the pouch sensors 522 are configured to monitor for whether one or more of the pouches 300 have been installed in an incorrect position. For example, if a pouch position has been designated for a particular flavor/additive, the processor 500 is configured to detect, based on data collected by the respective pouch sensor 522, whether the pouch installed at the designated pouch position includes the flavor/additive associated with the designated pouch position. Further, in some examples, the processor 500 is configured to detect, based on data collected by one of the pouch sensors 522, whether a pouch installed in a particular pouch position is an authorized pouch or a counterfeit. The use of counterfeit pouches may otherwise result in additional subsequent maintenance to the beverage dispenser 100.

In the illustrated example, the processor 500 is configured to control operation of the beverage dispenser 100 based on the collected input data. The processor 500 is communicatively connected, via a wired and/or wireless connection, to each of a plurality of output devices (e.g., the one or more motors 532, a solenoid valve 534 of FIG. 4, etc.) to control operation of those devices. In the illustrated example, the processor 500 is communicatively connected to each of the output devices via a motor control board 530. That is, the processor 500 is directly connected to the motor control board 530, and the motor control board 530 is directly connected to each of the output devices.

To control operation of the beverage dispenser 100, the processor 500 is configured to transmit one or more signals to control the flow rate of the flavor/additive stream based on data collected by the user interface 510, the pouch sensors 522, the flowrate sensor 524, the electrical current sensor 526, and/or other input devices. The processor 500 is configured to send a control signal to open and/or close a solenoid valve (e.g., a solenoid valve 534 of FIG. 4) that controls the water stream of the water source (e.g., a pressurized chiller unit). Additionally, the processor 500 is configured to send control signals to each of the respective motors 532 (e.g., stepper motors). Each of motors 532 is configured to control, based on a received control signal, operation of the respective pump 400 (e.g., a positive displacement pump), which, in turn, is configured to control the flow of the flavor/additive from the respective pouch 300. For example, the processor 500 causes the motors 532 to adjust the flow of additives via the pumps 400 based on (1) the target water-additive ratios for a beverage and (2) the flowrate of the water stream measured by the flowrate sensor 524. That is, the processor 500 causes the motors 532 to adjust the flowrates of the pumps 400 based on the measured flowrate of the water source to achieve the target water-additive ratios for the beverage.

During operation, a user selects a desired beverage via the user interface 510 and/or another interface device (e.g., a mobile device in communication with the beverage dispenser 100) and places a beverage container in a designated location. In some examples, the user is to subsequently select a dispense button of the user interface 510 to instruct the beverage dispenser 100 to dispense the selected beverage. In other examples, the beverage dispenser 100 identifies that the selected beverage is to be dispensed upon detecting (e.g., via one or more proximity sensors) that a beverage container has been placed by the user in the designated location.

Subsequently, the processor 500 of the beverage dispenser 100 retrieves a formula for the selected beverage from memory (e.g., memory 505 of FIG. 4). The formula identifies (1) which of the flavor/additive(s) are included in the selected beverage and (2) a concentration of each of the identified flavor/additive(s) within water. Based, at least in part, on data collected by the pouch sensors 522, the processor 500 identifies which of the pouches 300 installed within the beverage dispenser 100 corresponds with the selected beverage.

In some examples, if the beverage dispenser 100 does not include each of the requisite flavor/additive(s) for the selected beverage (e.g., due to a missing or empty pouch), the beverage dispenser 100 may emit a corresponding alert or notification to the user (e.g., via a display of the user interface). Further in some examples, the occurrence of the notification is recorded in the memory of the beverage dispenser and/or a remote server (e.g., a remote server 550 of FIG. 4 in communication with the beverage dispenser 100).

Otherwise, if the beverage dispenser 100 includes each of the requisite flavor/additive(s) for the selected beverage, the processor 500 sends a control signal to open a solenoid valve (e.g., a solenoid valve 534 of FIG. 4) to cause water to stream from the water source and through the manifold 200. Additionally, for each of the flavor/additive(s) corresponding with the selected beverage, the processor 500 sends a control signal to actuate the corresponding motor 532 at a predetermined speed. Actuation of the motor 532 at the predetermined speed causes the pump 400 to be driven at predetermined speed, which causes the flavor/additive to flow from the pouch 300 at a flowrate that results in the predefined concentration of the flavor/additive for the selected beverage. In some examples, the processor 500 determines the control signal for each of the flavor/additive(s) of the selected beverage further based on data collected by the flowrate sensor 524 monitoring the stream of water. For example, if the flowrate sensor 524 detects that the flowrate of the water stream has slowed, the processor 500 adjusts the control signals to slow the motors 532 connected to the pumps 400 in order to maintain the predefined concentration level(s) of the flavor/additive(s) within the selected beverage dispensed by the beverage dispenser 100.

The processor 500 of the illustrated example also is configured to control the brightness of a light source, such as a light ring disposed around the manifold 200, during a filling sequence of the beverage dispenser 100. The processor 500 is configured to cause the light ring and/or other light source to emit light at different brightness levels for different modes of operation of the beverage dispenser 100. For example, the light ring and/or other light source is configured to emit light at (1) a first predefined level (e.g., 0% brightness) in an off mode, (2) a second predefined level (e.g., 50% brightness) in a wake-from-sleep mode, (3) the second predefined level in a make-selection mode, (4) a third predefined level (e.g., 90% brightness) in a dispense mode, (5) the first predefined level in an after-dispense mode, (6) and the first predefined level in a rest mode. In other examples, one or more of the modes may correspond with different predefined brightness levels. For example, each mode of operation may correspond with a predefined brightness level that is unique to that mode of operation.

In some examples, the processor 500 causes the light ring and/or other light source to transition from the first brightness level to the second brightness level over a predefined period of time (e.g., 0.5 seconds) when the beverage dispenser 100 transitions from the off mode to the wake-from-sleep mode in response to the processor 500 detecting that a user has interacted with the user interface 510 (e.g., via a button, an audio command, a scannable code, etc.). The processor 500 causes the light ring and/or other light source to transition from the second brightness level to the first brightness level over a predefined period of time (e.g., 0.5 seconds) when the beverage dispenser 100 transitions from the wake-from-sleep-mode and/or the make-selection mode to the rest mode in response to the processor 500 detecting that the user has not interacted with the user interface 510 for another predefined period of time (e.g., 10 seconds). The processor 500 causes the light ring and/or other light source to transition from the second brightness level to the third brightness level over a predefined period of time (e.g., 0.5 seconds) when the beverage dispenser 100 transitions from the make-selection mode to the dispense mode in response to the processor 500 detecting that the user has selected a beverage and instructed the beverage dispenser 100 to begin dispensing the selected beverage. The processor 500 causes the light ring and/or other light source to transition from the third brightness level to the first brightness level over a predefined period of time (e.g., 0.9 seconds) when the beverage dispenser 100 transitions from the dispense mode to the after-dispense mode in response to the processor 500 detecting that the beverage dispenser 100 has stopped dispensing the selected beverage for another predefined period of time (e.g., 5 seconds).

Figure 4:
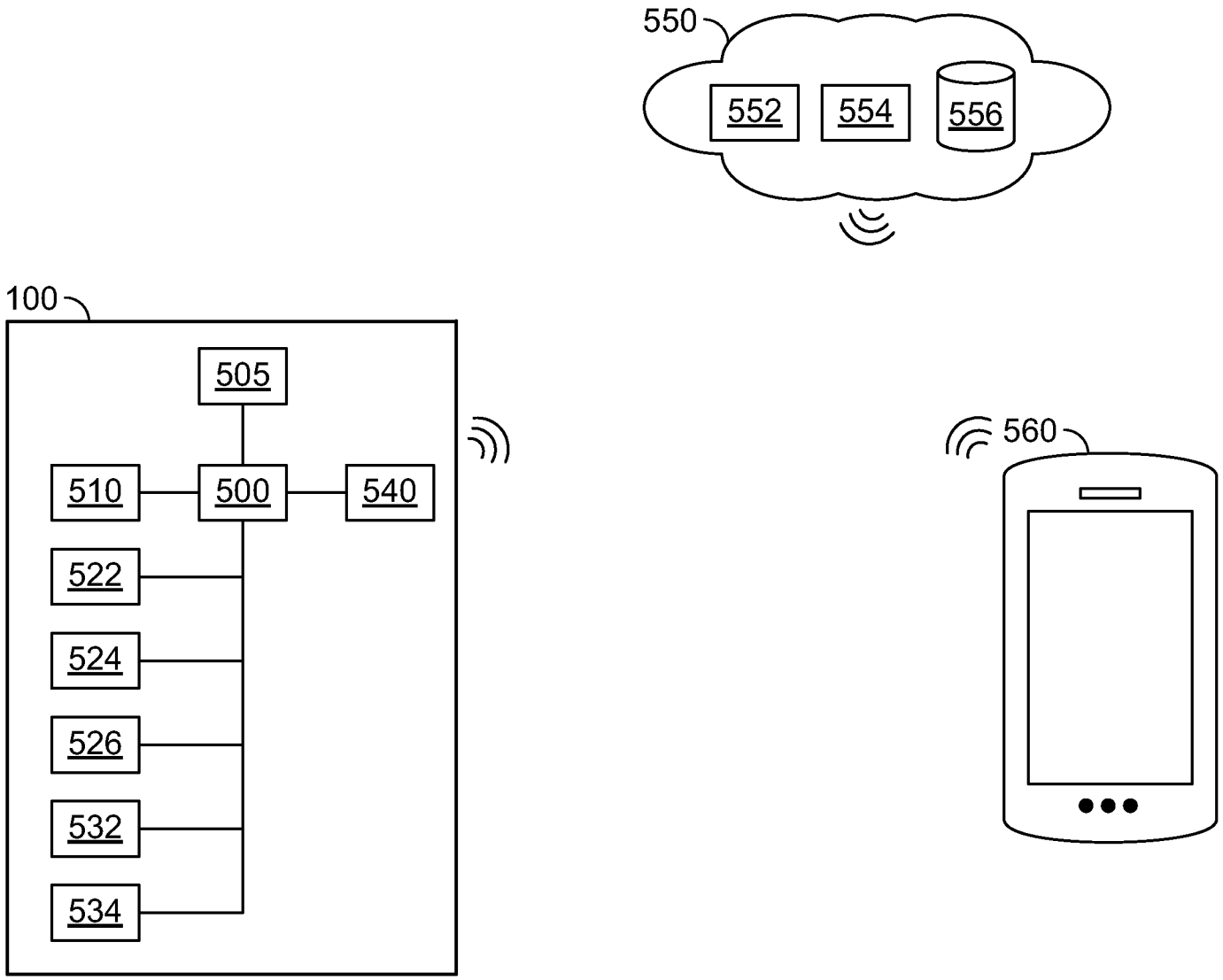
FIG. 4 depicts an example communications network for the beverage dispenser of FIG. 1 in accordance with the teachings herein.

FIG. 4 depicts the beverage dispenser 100 in communication with a remote server 550 (e.g., a cloud server) in accordance with the teachings herein. In the illustrated example, the beverage dispenser 100 includes input devices, such as the user interface 510, the pouch sensors 522, the flowrate sensor 524, and the electrical current sensor 526. The beverage dispenser 100 also includes output devices, such as the motors 532 and a solenoid valve 534. The processor 500 is configured to control operation of the output devices based on, at least in part, data collected from the input devices. The processor 500 may be any suitable processing device or set of processing devices such as, but not limited to, a microprocessor, a microcontroller-based platform, an integrated circuit, one or more field programmable gate arrays (FPGAs), and/or one or more application-specific integrated circuits (ASICs).

The beverage dispenser 100 also includes memory 505, which may be volatile memory (e.g., RAM including non-volatile RAM, magnetic RAM, ferroelectric RAM, etc.), non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc.). In some examples, the memory 505 includes multiple kinds of memory, particularly volatile memory and non-volatile memory.

The memory 505 is computer readable media on which one or more sets of instructions, such as the software for operating the methods of the present disclosure, can be embedded. The instructions may embody one or more of the methods or logic as described herein. For example, the instructions reside completely, or at least partially, within any one or more of the memory 505, the computer readable medium, and/or within the processor 500 during execution of the instructions.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

As illustrated in FIG. 4, the beverage dispenser 100 also includes a communication module 540 for communication with the remote server 550 and/or other devices. The communication module 540 includes wired or wireless network interfaces to enable communication with other devices and/or external networks. The external network(s) may be a public network, such as the Internet; a private network, such as an intranet; or combinations thereof, and may utilize a variety of networking protocols now available or later developed. The communication module 540 also includes hardware (e.g., processors, memory, storage, antenna, etc.) and software to control the wired or wireless network interfaces. For example, the communication module 540 includes one or more communication controllers for cellular networks, such as Long Term Evolution (LTE). In some examples, the communication module 540 includes a wireless personal area network (WPAN) module that is configured to wirelessly communicate with other device(s), such as other nearby beverage dispenser(s) and/or a personal computing device 560, via a wireless personal area network, such as Bluetooth® and/or Bluetooth® Low Energy (BLE). In some examples, the communication module 540 includes a wireless personal area network (WLAN) module that is configured to wirelessly communicate with other device(s) via a wireless local area network, such as Wi-Fi®. Additionally or alternatively, the communication module 540 is configured to wirelessly communicate with other device(s) via other network type(s), such as Near Field Communication (NFC). As used herein, the terms "communication module" refers to hardware with circuitry to provide communication capabilities. A "communication module" may also include firmware that executes on the circuitry.

In the illustrated example, the remote server 550 includes one or more processors 552 and memory 554. The processor(s) 552 may be any suitable processing device or set of processing devices such as, but not limited to, a microprocessor, a microcontroller-based platform, an integrated circuit, one or more field programmable gate arrays (FPGAs), and/or one or more application-specific integrated circuits (ASICs). The memory 554 may be volatile memory, non-volatile memory, unalterable memory, read-only memory, high-capacity storage devices, etc. The memory 554 is computer readable media on which one or more sets of instructions, such as the software for operating the methods of the present disclosure, can be embedded. The instructions may embody one or more of the methods or logic as described herein.

In the illustrated example, the memory 554 of the remote server 550 includes one or more databases 556 that are configured to store data related to the operation of the beverage dispenser 100 and/or other beverage dispensers in communication with the remote server 550. For example, for one or more beverage dispenser(s) in communication with the remote server 550, the database(s) 556 are configured to store pouch data (e.g., flavor type, fill level, expiration date, water ratio, and/or other data collected via the pouch sensors 522) of currently or previously installed pouches, diagnostics data (e.g., data collected by the pouch sensors 522, the flowrate sensor 524, and/or other sensor(s)), notifications (e.g., a notification for a pouch not being in a designated location, a notification for a counterfeit pouch being installed, etc.), etc.

The processor(s) 552 of the remote server 550 are capable of controlling operation features of one or more beverage dispensers (e.g., including the beverage dispenser 100). For example, if one of the pouch sensors 522 detects that a pouch has been installed within the beverage dispenser 100 is a counterfeit and/or beyond its best-by date, the processor(s) 552 of the remote server 550 are configured to transmit a signal to the communication module 540 of the beverage dispenser 100 to instruct the processor 500 of the beverage dispenser 100 to disable that pouch. As used herein, a "best-by date" refers to a date after which a food product, such as an additive, may no longer be in a preferred state for consumption. Additionally or alternatively, the processor(s)

552 of the remote server 550 are configured to remotely update operational applications for the beverage dispenser 100 and/or push background images for display via the user interface 510.

In some examples, the processor(s) 552 of the remote server 550 and/or the processor 500 of the beverage dispenser 100 are configured to identify a current fill level of each of the pouches 300 installed in the beverage dispenser 100. In some examples, each of the pouches 300 includes a level sensor configured to detect a current fill level of the respective pouch 300. Additionally or alternatively, for each of the pouches 300 that are installed, the processor(s) 552 and/or the processor 500 are configured to identify the current fill level based on an initial fill level of the pouch 300 at the time of installation, a flowrate of the flavor/additive from the pouch, and a total time during which the flavor/additive has flown from the pouch 300. For example, the processor(s) 552 and/or the processor 500 identify the initial fill level of each of the pouches 300 based on data collected by the respective pouch sensors 522 from the respective pouch tags 350. In other examples, the memory 505 and/or the memory 554 store a predefined initial fill level for the pouches 300. Further, in some examples, the memory 505 and/or the memory 554 store a predefined flowrate for the pouches 300. In other examples, the beverage dispenser 100 includes a flowrate sensor for each of the pouches 300 to measure the respective flowrate of the flavor/additive. Additionally, for each of the pouches 300, the processor 500 is configured to monitor and the memory 505, the memory 554, and/or the databases 556 are configured to store the amount of time that flavor/additive has been emitted from the pouch 300 after installation.

The processor(s) 552 of the remote server 550 are also capable of implementing an artificial intelligence (AI) algorithm stored in the memory 554 to monitor, control, and/or maintain operation of one or more beverage dispensers, such as the beverage dispenser 100. For example, the remote server 550 receives usage data collected by the sensors and the user interface 510 of the beverage dispenser 100 and analyzes the collected data utilizing the AI algorithm to detect current operating characteristics of the beverage dispenser 100. The processor(s) 552 of the remote server 550 are configured to utilize the AI algorithm to detect usage patterns of the pouches 300, recommend new pouches for the beverage dispenser 100, automatically order and send replacement pouches to replenish currently-installed pouches that have and/or are about to become empty, schedule preventative maintenance, etc. An example AI algorithm type utilized by the remote server(s) 552 is a machine learning algorithm. Machine learning algorithms are a form of AI algorithms that enable a system to automatically learn and improve from experience without being explicitly programmed by a programmer for a particular function. For example, machine learning algorithms access data (e.g., collected usage data of the beverage dispenser 100) and learn from the accessed data to improve performance of a particular function (e.g., determining pouch orders for the beverage dispenser 100). Example machine learning algorithms include artificial neural networks, decision trees, support vector machines, Bayesian networks, etc.

In the illustrated example, the remote server 550 is in communication with one or more personal computing devices 560, such desktop computer(s), laptop(s), tablet(s), smartphone(s), etc. An application is configured to operate on the personal computing device(s) 560 to enable monitoring and/or control of corresponding beverage dispensers. As used herein, an "app" and "application" refer to a process that is executed on a personal computing device and/or within an Internet browser of a personal computing device. For example, an app (e.g., a mobile app) includes a computer program and/or a software application that is downloaded and installed on the personal computing device 560 for use by the user of the personal computing device 560. In some examples, the database(s) 556 of the remote server 550 stores information identifying a beverage dispenser, a personal computing device, and/or a user to permit only people who have been designated to operate and/or service a particular beverage dispenser to control and/or monitor that particular beverage dispenser through the app.

The app of personal computing device 560 is configured to enable an operator to remotely monitor, control, and/or maintain operation of the beverage dispenser 100. For example, the app enables the user to remotely monitor operation features of the beverage dispenser 100, such as current capacity or fill levels of the pouches 300 and/or flavor/additive dispense time. Additionally, the app is configured to emit audio and/or visual alerts when one or more of the pouches 300 is below a predefined level, empty, beyond its best-by date, etc. Additionally or alternatively, the app enables the user to remotely control operation of one or more features of the beverage dispenser 100, for example, by instructing the processor 500 to deactivate one or more of the pouches 300 detected, by the respective pouch sensors 522, to be beyond its best-by date. In some examples, the processor 500 of the beverage dispenser 100 and/or the processor(s) 552 of the remote server 550 are configured to determine an expiration date of the pouch 300 to occur a predetermined time period after the pouch 300 is installed within the beverage dispenser 100 (e.g., 10 months) and/or manufactured. Additionally or alternatively, the app enables the user of the personal computing device 560 to remotely instruct the remote server 550 and/or the processor 500 of the beverage dispenser 100 to record preventative maintenance operations performed for the beverage dispenser 100 within the database(s) 556 of the remote server 550.

Figure 5A:
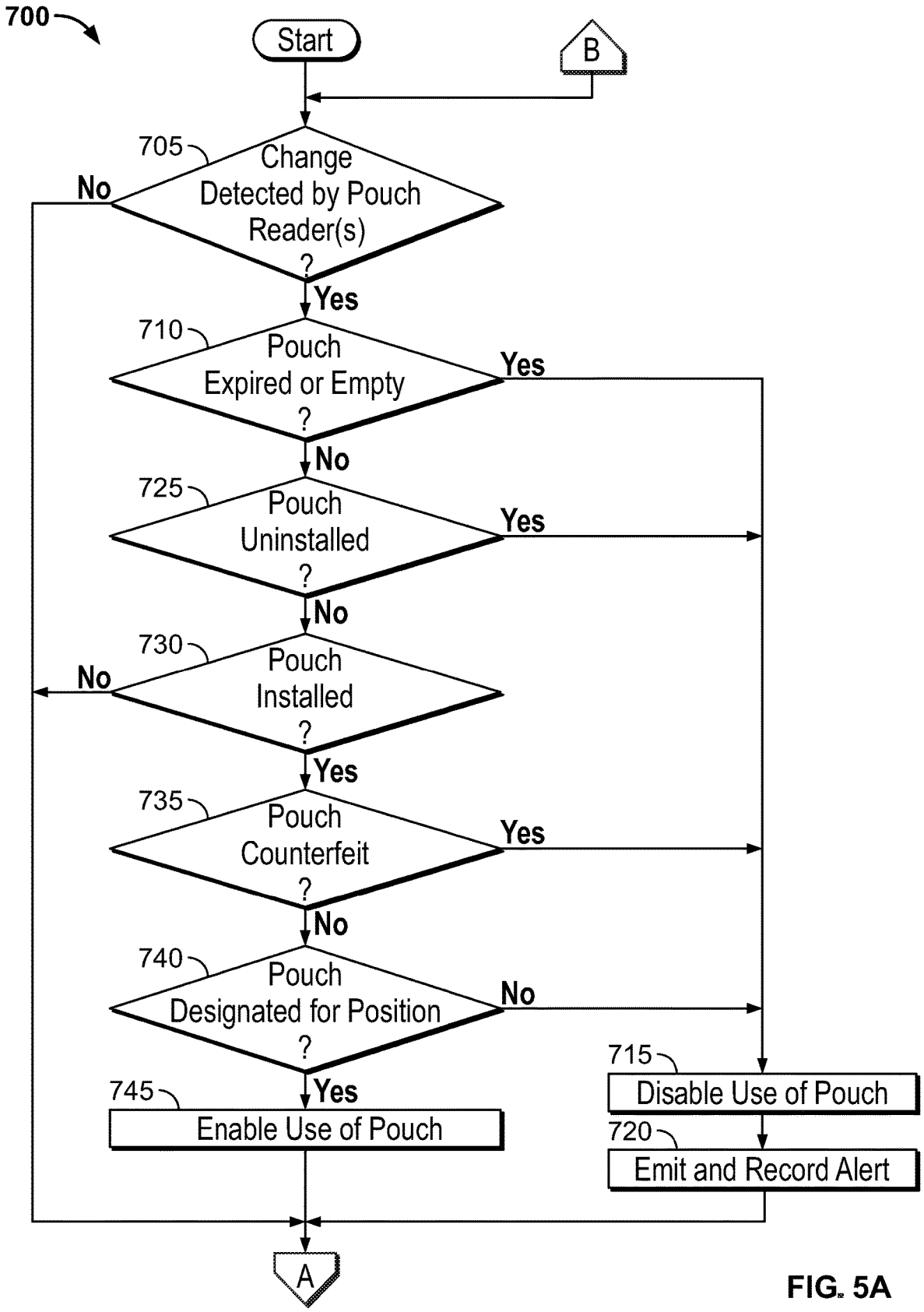
FIGS. 5A and 5B depicts an example flowchart for operation of the beverage dispenser of FIG. 1 in accordance with the teachings herein.
Figure 5B:
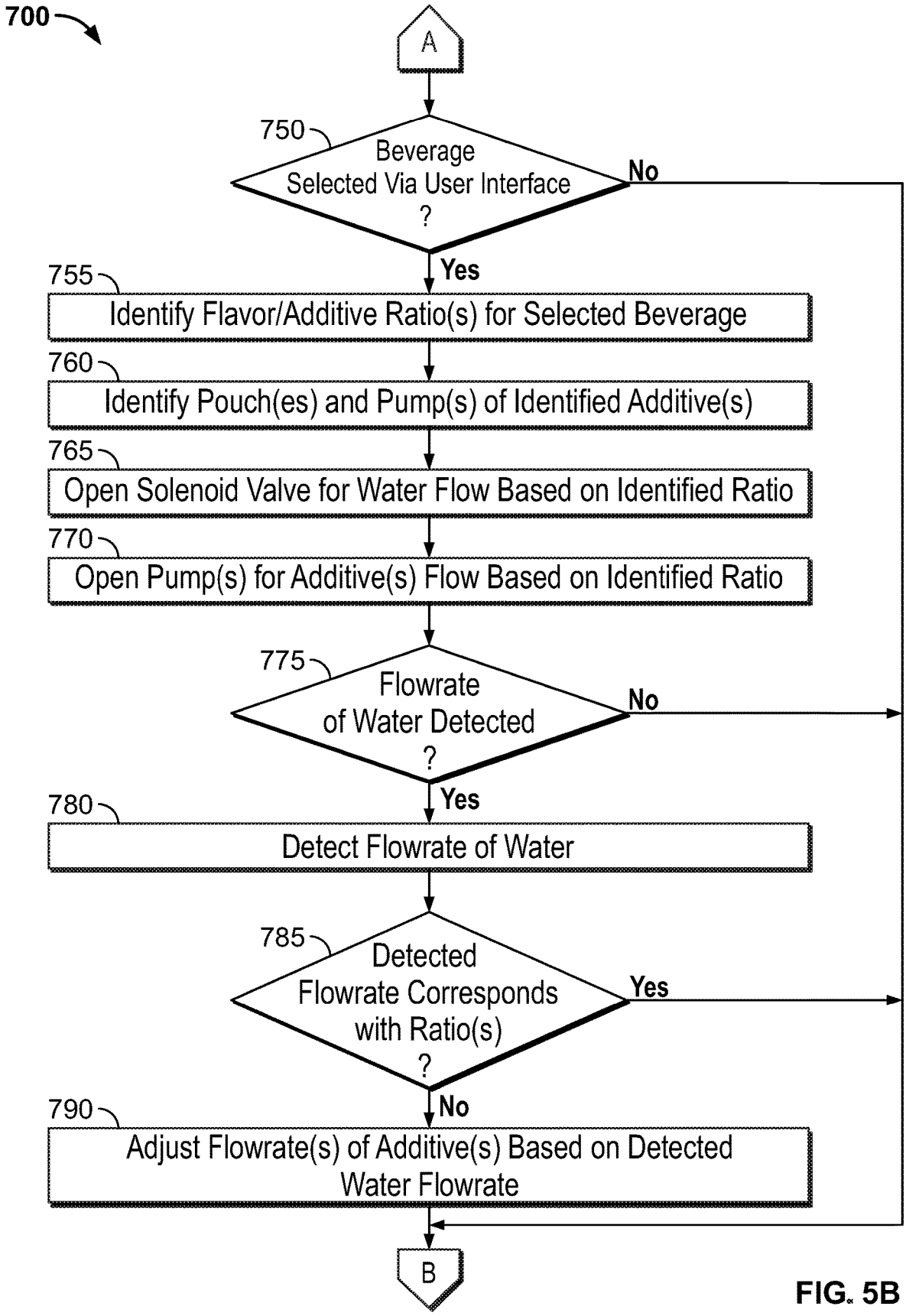

FIGS. 5A and 5B provide a flowchart of an example method 700 to operate a beverage dispenser in accordance with the teachings herein. The flowchart of FIGS. 5A and 5B is representative of machine readable instructions that are stored in memory (such as the memory 505 and/or the memory 554 of FIG. 4) and include one or more programs which, when executed by a processor (such as the processor 500 and/or the processor(s) 552 of FIG. 4) control operation of beverage dispenser(s). While the example program is described with reference to the flowchart illustrated in FIGS. 5A and 5B, many other methods may alternatively be used. For example, the order of execution of the blocks may be rearranged, changed, eliminated, and/or combined to perform the method 700. Further, because the method 700 is disclosed in connection with the components of FIGS. 1-4, some functions of those components will not be described in detail below.

Initially, at block 705 of FIG. 5A, the processor 500 of the beverage dispenser 100 determines whether there is a change in status detected by one or more of the pouch sensors 522. In response to the processor 500 determining that there has not been a detected status change for any of the pouches 300, the method 700 proceeds to block 750 of FIG. 5B. Otherwise, in response to the processor 500 determining that there has been a detected status change for one or more of the pouches 300, the method 700 proceeds to block 710 of FIG. 5A for each of the pouches 300 having a detected status change.

At block 710, the processor 500 determines, based on data collected by the pouch sensor 522, whether the pouch 300 is beyond its best-by date and/or empty. In response to the processor 500 determining that the pouch 300 is beyond its best-by date and/or empty, the method 700 proceeds to block 715 at which the processor 500 disables use of the pouch 300 and block 720 at which the processor 500 causes a corresponding alert or notification to be emitted and/or recorded. Upon completion of block 720, the method 700 proceeds to block 750 of FIG. 5B.

Returning to block 710 of FIG. 5A, the method 700 subsequently proceeds to block 725 in response to the processor 500 determining that the pouch 300 is not beyond its best-by date and is not empty. At block 725, the processor 500 determines, based on data collected by the pouch sensor 522, whether the pouch 300 has been uninstalled. For example, the processor 500 determines that the pouch 300 has been uninstalled if the pouch sensor 522 no longer detects the presence of the corresponding pouch tag 350. In response to the processor 500 determining that the pouch 300 has been uninstalled, the method 700 proceeds to block 715 at which the processor 500 disables use of the pouch 300 and block 720 at which the processor 500 causes an alert to be emitted and/or recorded. Otherwise, in response to the processor 500 determining that the pouch 300 has not been uninstalled, the method 700 proceeds to block 730.

At block 730, the processor 500 determines, based on data collected by the pouch sensor 522, whether a replacement pouch has been installed at a designated pouch location corresponding with the pouch sensor 522. For example, the processor 500 determines that a replacement pouch has been installed if the pouch sensor 522 detects the presence of the pouch tag 350 of the pouch 300 for the first time. In response to the processor 500 determining that a replacement pouch has not been installed, the method 700 proceeds to block 750. Otherwise, in response to the processor 500 determining that a replacement pouch has been installed, the method 700 proceeds to block 735.

At block 735, the processor 500 determines, based on data collected by the pouch sensor 522, whether the pouch 300 installed at a designated pouch location is a counterfeit. For example, the processor 500 determines that the pouch 300 is a counterfeit if the pouch sensor 522 does not recognize the data of the corresponding pouch tag 350. In some examples, the processor determines that the pouch 300 is a counterfeit if (i) the presence of the pouch is detected (e.g., via a proximity sensor) and (ii) the pouch sensor 522 is unable to detect a corresponding pouch tag (e.g., if the counterfeit pouch does not include a tag). In response to the processor 500 determining that the pouch 300 is a counterfeit, the method 700 proceeds to block 715 at which the processor 500 disables use of the pouch 300 and block 720 at which the processor 500 causes an alert to be emitted and/or recorded. Otherwise, in response to the processor 500 determining that the pouch 300 is not a counterfeit, the method 700 proceeds to block 740.

At block 740, the processor 500 determines whether the pouch 300 that has been installed is designated for the pouch location corresponding with the pouch sensor 522. That is, the processor 500 determines whether the pouch 300 has been installed at the correct, designated position within the beverage dispenser 100. For example, the processor 500 determines that the pouch 300 does not correspond with the pouch position of the pouch sensor 522 in response to identifying that the pouch sensor 522 has collected information from the pouch tag 350 that indicates (i) the pouch 300 is not a counterfeit and (ii) the flavor/additive of the pouch 300 is not designated for the pouch location of the pouch sensor 522. In response to the processor 500 determining that the pouch 300 is not designated for use at the pouch location, the method 700 proceeds to block 715 at which the processor 500 disables use of the pouch 300 and block 720 at which the processor 500 causes an alert to be emitted and/or recorded. Otherwise, in response to the processor 500 determining that the pouch 300 is designated for use at the pouch location, the method 700 proceeds to block 745 at which the processor 500 permits the pouch 300 to be used for dispensing selected beverages. Upon completion of block 745, the method 700 proceeds to block 750 of FIG. 5B.

At block 750, the processor 500 determines whether a user has selected a beverage via the user interface 510. In response to the processor 500 determining that no beverage has been selected via the user interface 510, the method 700 returns to block 705 of FIG. 5A. Otherwise, in response to the processor 500 determining that a beverage has been selected via the user interface 510, the method 700 proceeds to block 755.

At block 755, the processor 500 identifies which flavor/additive(s) are to be added to water for the selected beverage. Additionally, for each of the identified flavor/additive(s), the processor 500 identifies a target ratio between the flavor/additive and water. In some examples, the processor 500 retrieves the flavor/additive and corresponding ratio information from the memory 505 of the beverage dispenser 100. That is, for each selectable beverage, the memory 505 stores a recipe that identifies which flavor/additive(s) to add to water and at which ratio(s). At block 760, the processor 500 identifies which of the pouches 300 contain the flavor/additive(s) for the selected beverage. Additionally, the processor 500 identifies which of the pumps 400 correspond with the identified pouches 300.

At block 765, the solenoid valve 534 opens to enable chilled water from the pressurized water unit to flow to the manifold 200. The processor 500 transmits a signal to the solenoid valve 534, via the motor control board 530, to instruct the solenoid valve 534 open by an amount that causes the water to flow with a flowrate that corresponds with the retrieved recipe. At block 770, the pumps 400 that control flow of the pouches 300 identified for the selected beverage are opened to form the selected beverage. The processor 500 transmits a signal, via the motor control board 530, to each of the pumps 400 identified for the selected beverage to instruct the pump to open by an amount and/or duration that causes a predefined amount of the corresponding flavor/additive to be mixed into the water flow. That is, each of the pumps 400 identified for the selected beverage is opened by a degree and/or duration that enables the corresponding flavor/additive(s) to be added to the water flow at a ratio defined by the retrieved recipe to form the selected beverage.

At block 775, the processor 500 determines whether the flowrate sensor 524 is monitoring the flowrate of the water flowing to the manifold 200. In response to the processor 500 identifying that the flowrate sensor 524 is not collecting flowrate measurements, the method 700 returns to block 705 of FIG. 5A. Otherwise, in response to the processor 500 identifying that the flowrate sensor 524 is collecting flowrate measurements, the method 700 proceeds to block 780 of FIG. 5B.

At block 780, the processor 500 identifies the flowrate of the water detected by the flowrate sensor 524. At block 785, the processor 500 determines whether the detected flowrate provides an amount of water that corresponds with the additive/water ratio(s) of the recipe of the selected beverage. For example, a greater flowrate may provide too much water for the additive/water ratio(s), and a lesser flowrate may provide too little water for the additive/water ratio(s). In response to the processor 500 determining that the detected flowrate corresponds with the additive/water ratio(s) of the selected beverage recipe, the method 700 returns to block 705 of FIG. 5A. Otherwise, in response to the processor 500 determining that the detected flowrate does not correspond with the additive/water ratio(s) of the selected beverage recipe, the method 700 proceeds to block 790 of FIG. 5B.

At block 790, the processor 500 adjusts the control signal(s) for the pump 400 to adjust the amount of flavor/additive(s) being added to the flow of water. For example, if the water flowrate is less than expected for the corresponding ratio of the recipe, the processor 500 causes the pumps 400 that are activated to reduce the flowrate(s) of the corresponding flavor/additive(s). In contrast, if the water flowrate is greater than expected for the corresponding ratio of the recipe, the processor 500 causes the pumps 400 that are activated to increase the flowrate(s) of the corresponding flavor/additive(s). Additionally or alternatively, the processor 500 causes the solenoid valve 534 to adjust the flowrate of the water. For example, if the water flowrate is less than expected, the processor 500 causes the solenoid valve 534 to increase the water flowrate. If the water flowrate is greater than expected, the processor 500 causes the solenoid valve 534 to reduce the water flowrate. Upon completion of block 790, the method 700 returns to block 705 of FIG. 5A.

FIGS. 6-14D depict features of the example manifold 200 of the beverage dispenser 100 in accordance with the teachings herein. As illustrated in FIGS. 6-7 and 9-10, the manifold 200 includes a base 210, a housing 220, a body 230 (also referred to as a "flow-straightener body"), a cover 250, and one or more nozzle holders 270 (also referred to as "inserts," "orientation inserts," "flavor-nozzle inserts," and "nib inserts").

Figure 7:
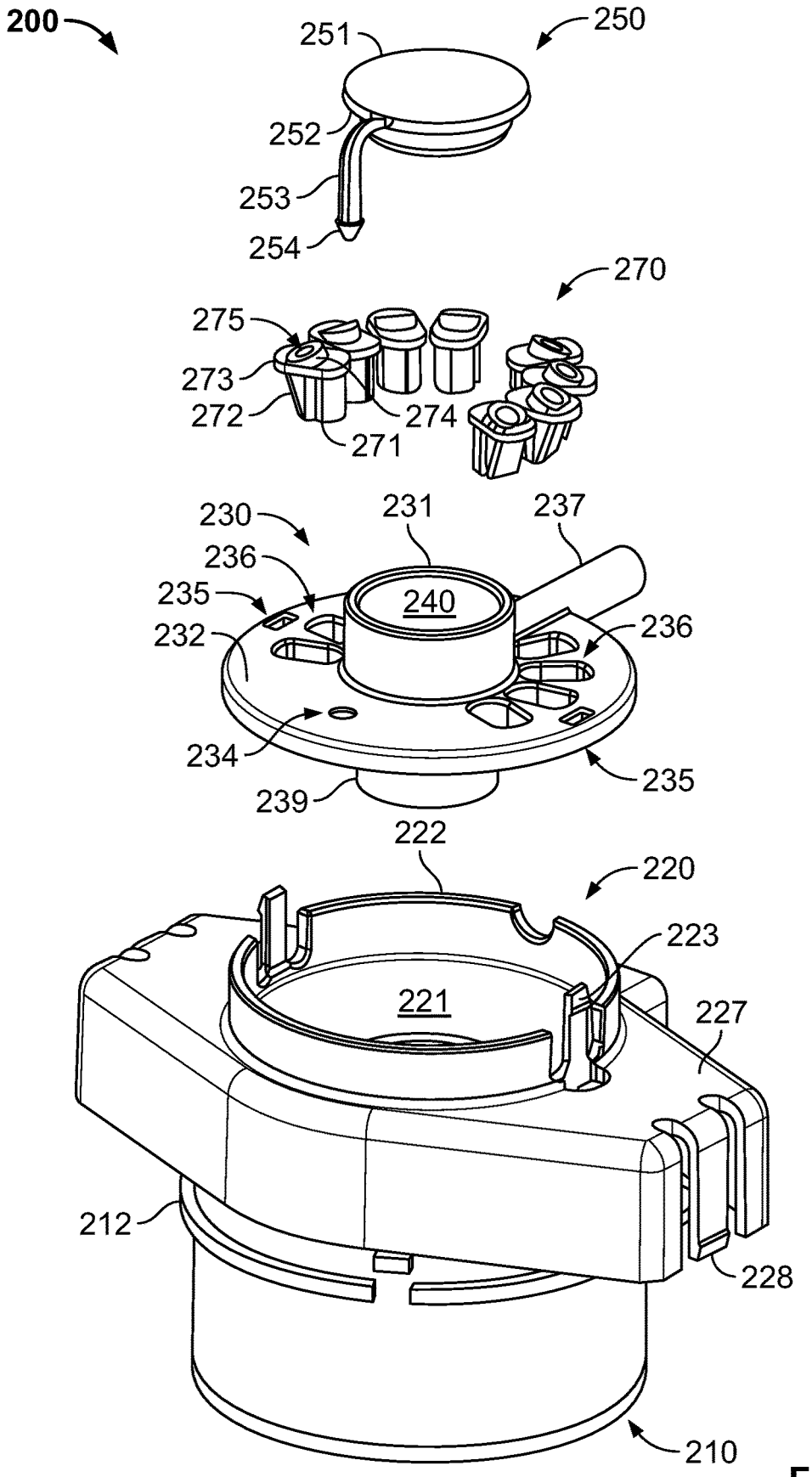
FIG. 7 is an exploded view of the manifold of FIG. 6.

Returning briefly to FIG. 2, the base 210 of the illustrated example is configured to extend through an opening defined by the outer wall 280 to enable the manifold 200 to dispense a beverage from above the dispensing area 134. As illustrated in FIG. 7, the base 210 includes a lip 212 that extends circumferentially along a body of the base 210. The lip 212 is configured to rest on the outer wall 280 adjacent the opening to prevent the base 210 from falling through the opening.

Figure 6:
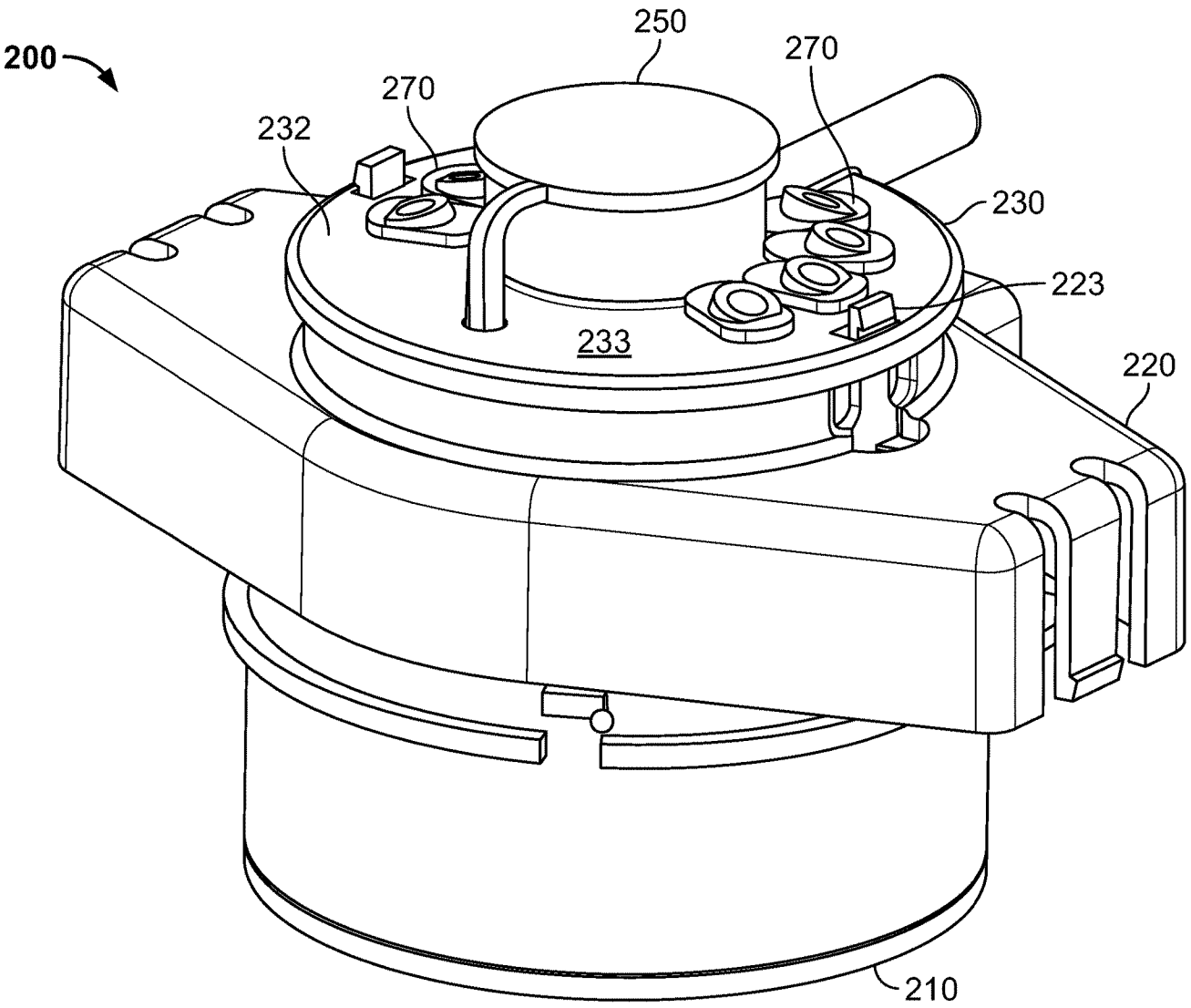
FIG. 6 illustrates an example manifold of the beverage dispenser in accordance with the teachings herein.
Figure 9:
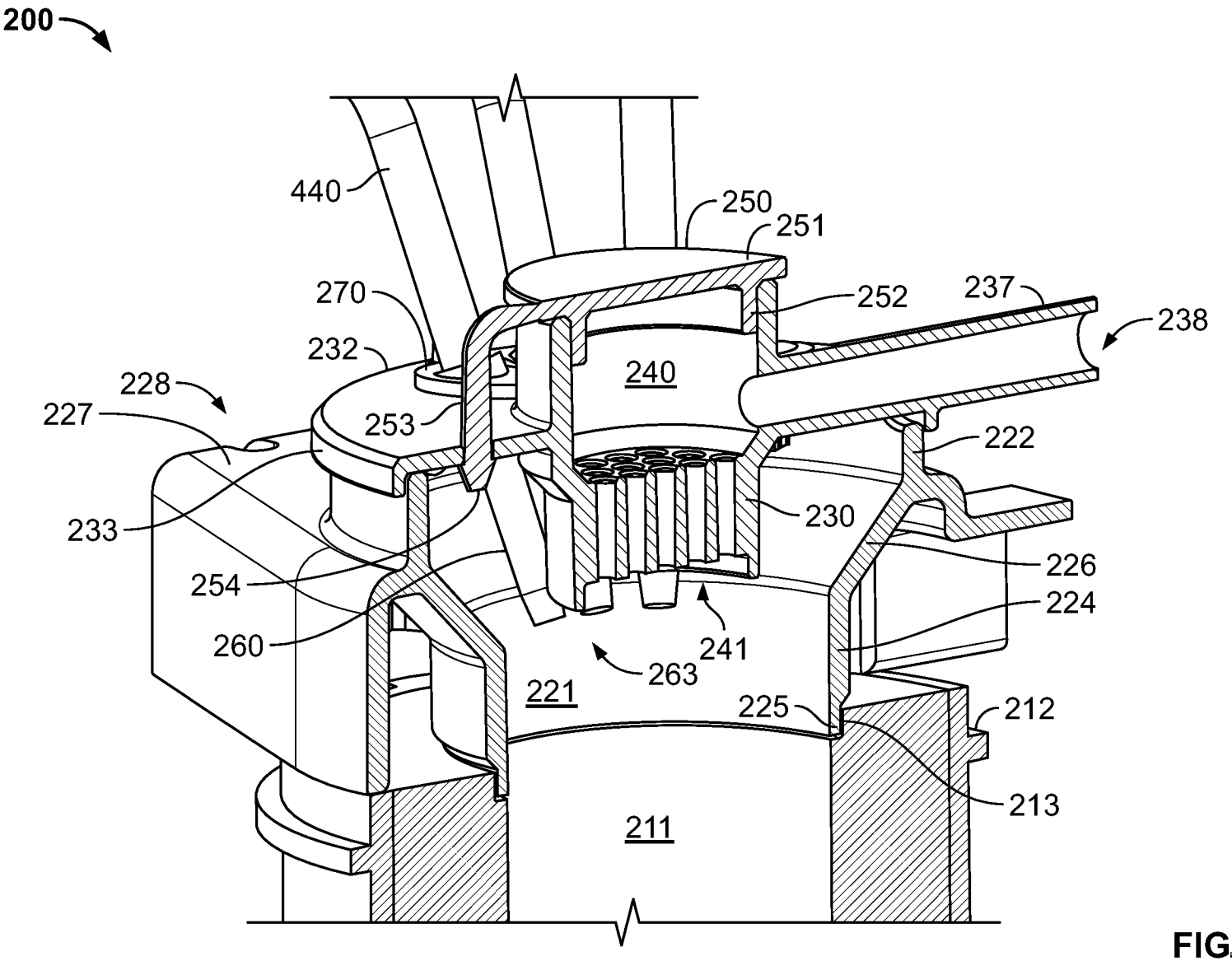
FIG. 9 is a cross-sectional view of the manifold of FIG. 6.

The housing 220 of the manifold 200 couples to an upper portion of the base 210. As illustrated in FIG. 9, a lip 225 of a lower portion 224 of the housing 220 is matingly received by a lip 213 of the base 210 to couple the housing 220 to the base 210. In FIGS. 6-7, the housing 220 includes clips 228 (e.g., snap fit clips) that are configured to securely fasten the housing 220, as well as the base 210 coupled to the housing 220, to the outer wall 280 of the beverage dispenser 100. In other examples, such as a housing 220' of FIGS. 11A-11B, fasteners 282 extend through apertures defined by a flange 227 of the housing 220' to securely fasten the housing 220, as well as the base 210 coupled to the housing 220, to the outer wall 280 of the beverage dispenser 100.

The housing 220 of the illustrated example also includes an upper portion 222. As illustrated in FIG. 9, the upper portion 222 has an inner diameter that is greater than that of the lower portion 224. The housing 220 includes a conical portion 226 between the upper portion 222 and the lower portion 224 that transitions from the inner diameter of the upper portion 222 to that of the lower portion 224. In the illustrated example, the flange 227 of the housing 220 extends outwardly from the upper portion 222 and/or the conical portion 226. Returning to FIG. 7, the upper portion 222 of the housing 220 is configured to couple to the body 230 of the manifold 200. One or more clips 223 (e.g., snap-fit clips) of the housing 220 are configured to extend through clip openings 235 of the body 230 to securely couple the body 230 to the housing 220. In other examples, the housing 220 is configured to detachably couple to the body 230 via other fastening means, such as threading and/or fasteners (e.g., threaded fasteners).

Figure 8:
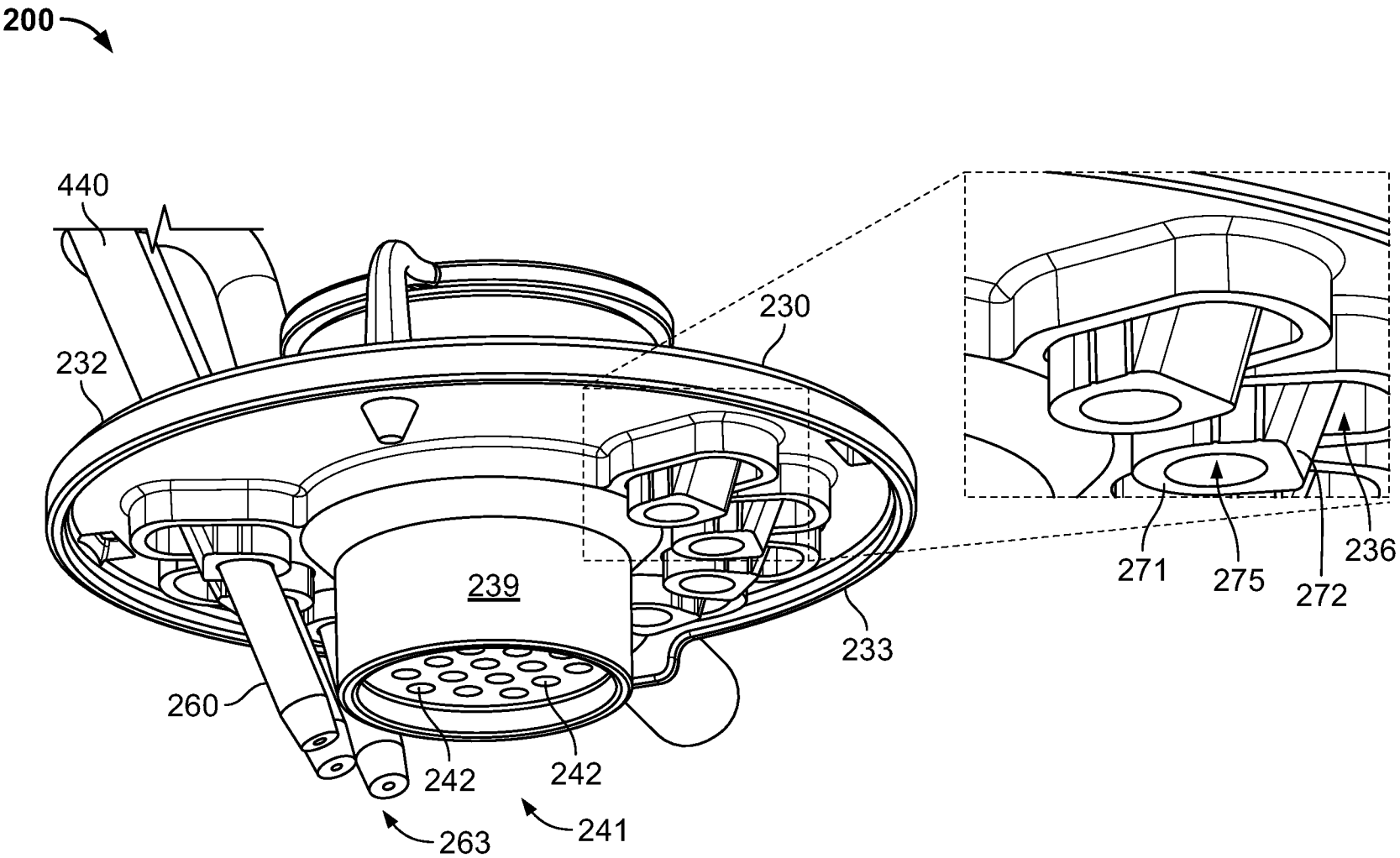
FIG. 8 illustrates an underside of the manifold of FIG. 6.

The body 230 of the illustrated example includes an upper portion 231, a flange 232, an arm 237, and a lower portion 239. The upper portion 231 and/or the lower portion 239 define a cavity 240 of the body 230. In the illustrated example, the lower portion 239 is aligned with and substantially parallel to the upper portion 231. The flange 232 is positioned between the upper portion 231 and the lower portion 239. That is, the upper portion 231 extends above the flange 232, and the lower portion 239 extends below the flange 232. The lower portion 239 is configured to extend into and be at least partially disposed within a cavity 221 of the housing 220 when the body 230 is coupled to the housing 220. As illustrated in FIG. 8, the lower portion 239 defines one or more passageways 242 that define an outlet 241 of the body 230. The outlet 241 of the body 230 is positioned within the cavity 221 of the housing 220 when the body 230 is coupled to the housing 220.

Figure 10:
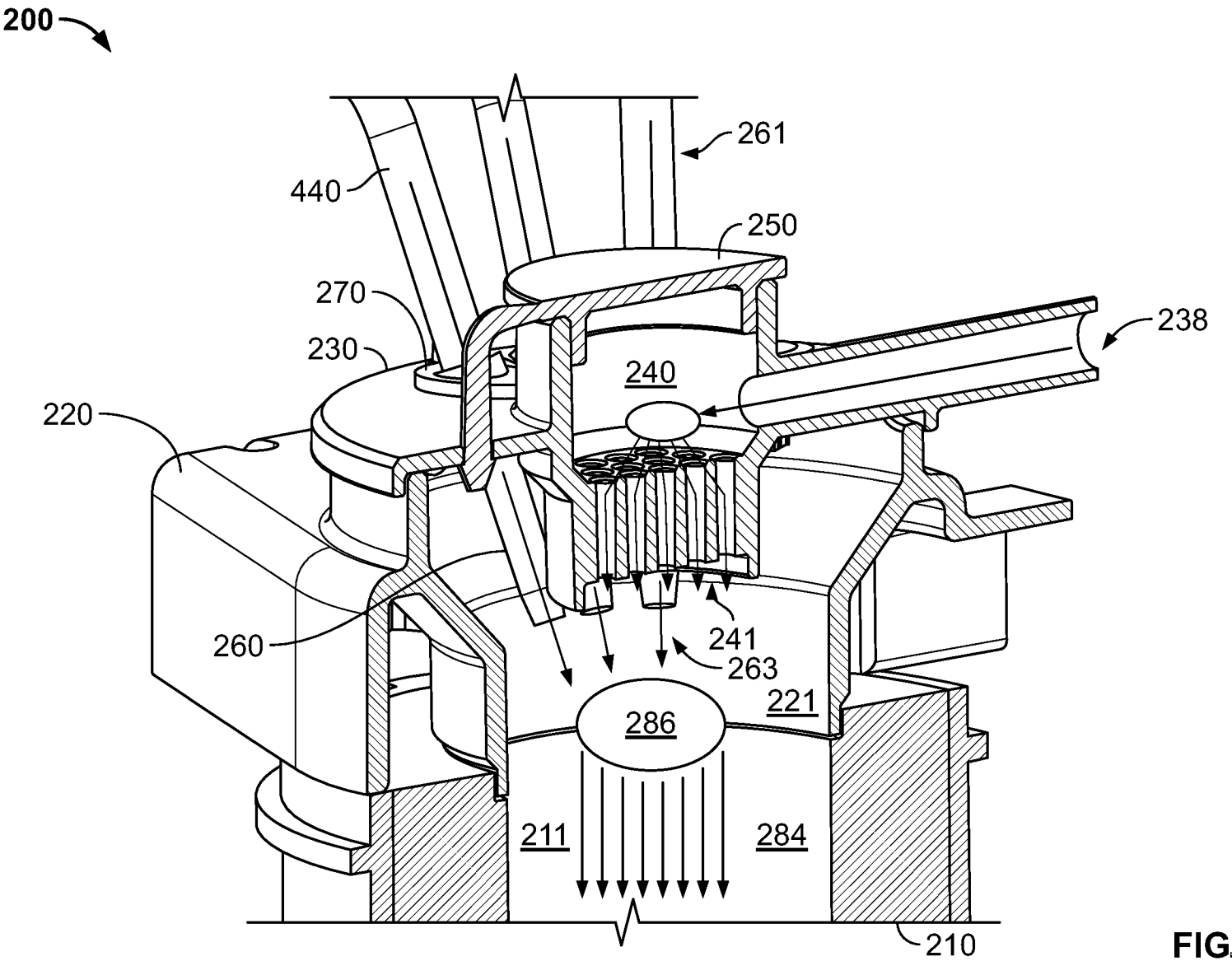
FIG. 10 is another cross-sectional view of the manifold of FIG. 6 that depicts fluid flow through the manifold.

The flange 232 of the illustrated example extends radially outwardly away from the upper portion 231 and the lower portion 239 in a direction that is substantially perpendicular to the upper portion 231 and the lower portion 239. Additionally, the arm 237 of the illustrated example extends outwardly from the cavity 240. The arm 237 extends along and/or parallel to the flange 232 such that the arm 237 is substantially perpendicular to the upper portion 231 and the lower portion 239. As illustrated in FIGS. 9 and 10, the arm 237 defines an inlet 238 configured to receive a stream of water from a pressurized chiller unit.

Returning to FIGS. 6 and 7, the flange 232 defines the clip openings 235 through which the clips 223 of the housing 220 extend to secure the body 230 to the housing 220. As further illustrated in FIG. 9, a lip 233 extends downwardly from a distal end of the flange 232. The lip 233 is configured to at least partially extend over the upper portion 222 of the housing 220 to facilitate the body 230 in securely coupling to the housing 220. Returning to FIG. 7, the flange 232 also defines a cord opening 234 and insert openings 236. The cord opening 234 is configured to receive a cord 253 of the cover 250, and each of the insert openings 236 are configured to receive and at least partially house a respective one of the nozzle holders 270. In other examples, each of the nozzle holders 270 is integrally formed with the flange 232 of the body 230 such that the flange 232 does not define the insert openings 236 for the nozzle holders 270.

The cover 250 of the illustrated example includes a cap 251, a flange 252, the cord 253, and a snap-fit connector 254. In the illustrated example, the cap 251, the flange 252, the cord 253, and the snap-fit connector 254 of the cover 250 are integrally formed together. The snap-fit connector 254 is configured to extend into and through the cord opening 234 of the body 230 to securely couple the cover 250 to the body 230. Additionally, the cap 251 of the cover 250 is configured to engage the upper portion 231 of the body 230 to cover an opening 247 (FIG. 13) of the cavity 240. As further illustrated in FIG. 9, the flange 252 extends into the cavity 240 and sealingly engages a portion of the upper portion 231 of the body 230 to enable the cover 250 to sealingly enclose the cavity 240 of the body 230. Additionally, the cord 253 that extends between the cap 251 and the snap-fit connector 254 is formed of flexible material to facilitate the cap 251 in transitioning between a covered position and an uncovered position, relative to the body 230, when the snap-fit connector 254 has securely coupled the cover 250 to the body 230. In other examples, the cover 250 does not include the cord 253 and the snap-fit connector 254 such that the cover 250 is able to disconnect from the body 230 when the cap 251 disengages from the upper portion 231 of the body 230 to cover the opening 247 of the cavity 240.

Figure 11B:
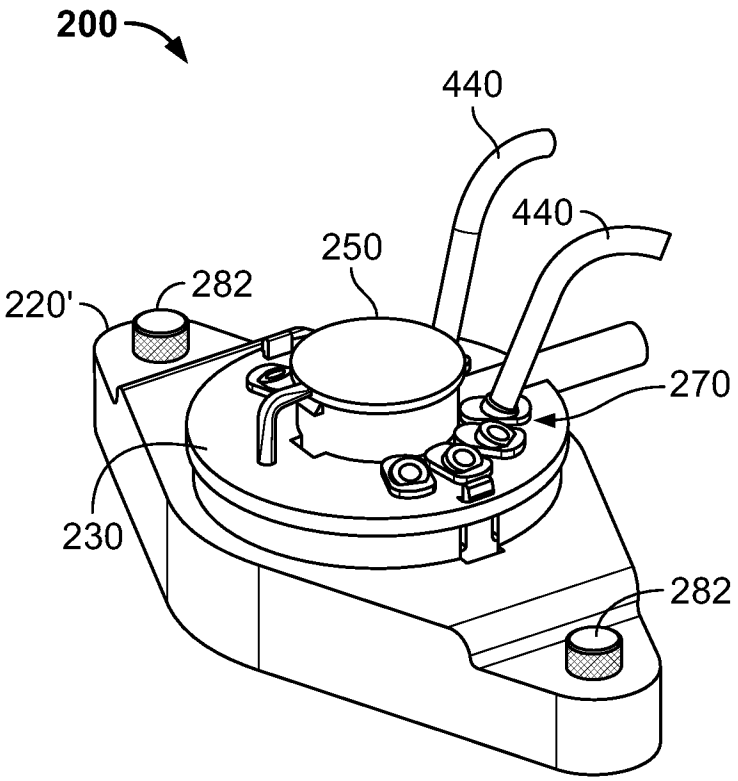
FIGS. 11A and 11B depict flavor nozzles being positioned within the manifold of FIG. 6.

Additionally, each of the nozzle holders 270 defines an aperture 275 that is configured to receive a respective one of the flavor nozzles 260. Each of the nozzle holders 270 of the illustrated example includes a lower portion 271, a middle portion 273, and an upper portion 274. As illustrated in FIG. 8, the lower portion 271 of each of the nozzle holders 270 is configured to extend into and at least partially through a respective one of the insert openings 236 of the body 230. As illustrated in FIG. 7, the middle portion 273 of each of the nozzle holders 270 is configured to engage and rest on an upper surface of the flange 232 of the body 230. Additionally, as illustrated in FIG. 11B, the upper portion 274 of each of the nozzle holders 270 defines a surface on which a respective one of the flavor nozzles 260 is configured to rest in place.

Returning to FIG. 8, the lower portion 271 of each of the nozzle holders 270 includes an angled wall 272. The angled wall 272 is angled at a predefined angle (e.g., a 20-degree angle) relative to a vertical axis of the insert 270. The angled wall 272 at least partially defines the aperture 275 through which one of the flavor nozzles 260 is to extend such that the aperture 275 is directed at the predefined angle toward a center vertical axis of the manifold 200 (e.g., a vertical axis extending through a center point of the outlet 241 of the body 230) when the insert 270 is received by the insert opening 236 of the body 230. Each of the nozzle holders 270 and the insert openings 236 are uniformly shaped and arranged such that the aperture 275 of any of the nozzle holders 270 is always oriented at the predefined angle when inserted into any of the insert openings 236. Further, the aperture 275 of any of the nozzle holders 270 receives any of the flavor nozzles 260, an outlet 263 of the respective one of the flavor nozzles 260 is oriented at the predefined angle. In other examples, the nozzle holders 270 are integrally formed with the body 230 such that the body 230 defines the apertures 275 of the nozzle holders 270 and does not define the insert openings 236 for the nozzle holders 270.

FIG. 10 depicts the manifold 200 during operation of the beverage dispenser 100. To dispense a beverage selected by a user, a stream of water flows through the body 230. More specifically, the inlet 238 of the body 230 receives a stream of water from a source (e.g., a pressurized chiller unit). The water stream flows into the cavity 240 of the body 230. Subsequently, the water flows through the passageways 242 of the outlet 241 of the body 230 in a substantially vertical, downward direction into a chamber 284 formed by a cavity 211 of the base 210 and/or the cavity 221 of the housing 220. The outlet 241 of the body 230 is formed by a plurality of the passageways 242 to create a inform water flow with reduced pressure. The reduced pressure and the uniform water flow facilitates subsequent mixture with one or more flavor/additive(s).

As illustrated in FIG. 10, one or more flavor/additive(s) flow through respective one(s) of the flavor nozzles 260. The flavor/additive(s) are emitted out of the outlet 263 of the respective one(s) of the flavor nozzles 260 and into the chamber 284 formed by the base 210 and/or the housing 220. Each of the flavor nozzles 260 is configured to spray a respective flavor/additive at a predefined injection angle (e.g., a 20-degree angle formed between the water stream and the flavor/additive stream) such that the flavor/additive is injected into the water stream at a mid-air injection point 286, which is located within the chamber 284, without contacting a surface of the manifold 200. The mixture of the water and the flavor/additive(s) is subsequently dispensed from the manifold 200 in a substantially vertical direction into a container located within the dispensing area 134. That is, the manifold 200 is configured to separate flavor/additive flow components and water flow components until right before the flavor/additive(s) are mixed with the water to maintain the cleanliness of the manifold 200.

In some examples, the manifold 200 includes a light ring for emitting light (e.g., cool white light) within the dispensing area 134. In such examples, the light ring includes a plurality of LEDs that are positioned circumferentially around the base 210 of the manifold 200. The light ring is configured to emit (1) visible side light to indicate to a user where to place a container within the dispensing area 134 and/or (2) ambient down lighting onto the tray 136 to illuminate the dispensing area 136. Additionally or alternatively, the light ring is configured to emit light to identify a current operating mode of the beverage dispenser 100 for the user. In some examples, the light ring is held in place by hanging and/or otherwise positioning at least a portion of a light ring housing between the flange 227 of the housing 220 and the base 210. Further, in some examples, the light ring housing includes an opaque light lens that extends circumferentially around the base 210 and a light-emitting portion extending from the bottom of the light ring housing to limit the direction of light emission. For example, the light ring is configured and positioned to eliminate and/or otherwise reduce light hotspots that extend along sidewalls of the dispensing area, highlight individual LEDs of the light ring, and/or create edges of downlighting.

Figure 11A:
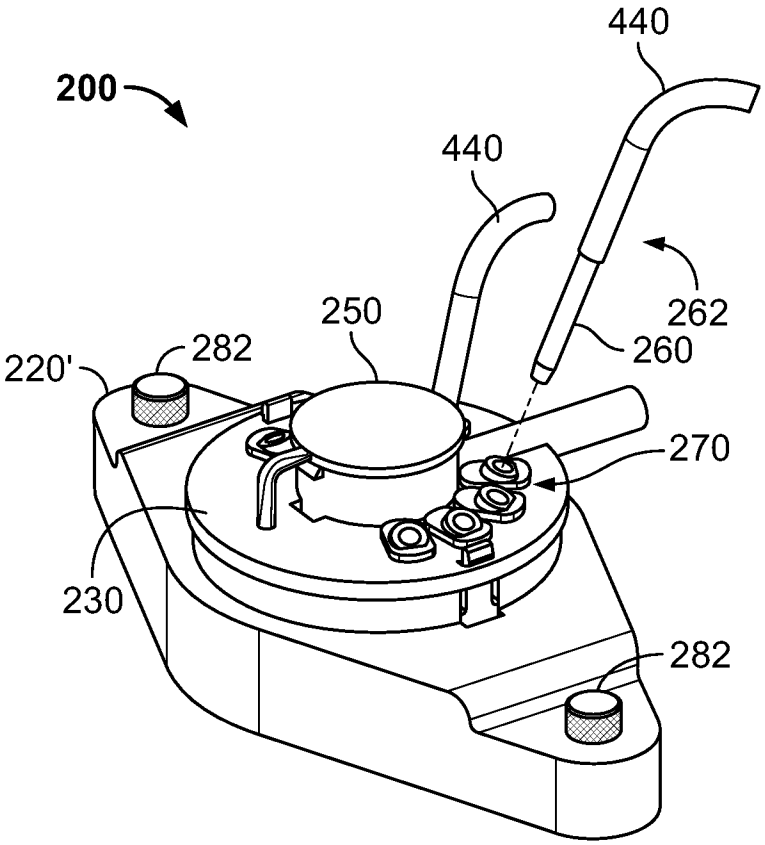

FIGS. 11A and 11B illustrate the flavor nozzles 260 being positioned within the manifold 200. More specifically, FIG. 11A depicts one of the flavor nozzles 260 before insertion into the manifold 200, and FIG. 11B depicts two of the flavor nozzles 260 when inserted into the manifold 200.

In FIGS. 11A and 11B, the manifold 200 includes the body 230, the cover 250, the nozzle holders 270 for the flavor nozzles 260, and fasteners 282 for coupling the manifold 200 to the outer wall 280 of the beverage dispenser 100. The manifold 200 also includes another example body 220' in accordance with the teachings herein. While the body 220' is shaped differently relative to the body 230, the elements and functionality of the body 220' are identical or substantially similar to those of the body 230 disclosed above. As such, those features of the body 220' will not be disclosed again in further detail below.

Further, as illustrated in FIG. 11A, each of the flavor nozzles 260 connects to a respective line of the tubing 440. For example, a portion of each of the flavor nozzles 260 that defines an inlet 262 is received by an end of the respective line of the tubing 440 to securely and fluidly connect the flavor nozzle 260 to the tubing 440. In the illustrated example, the outer diameter of each of the flavor nozzles 260 is less than an inner diameter of the aperture 275 of the nozzle holders 270 to enable the flavor nozzles 260 to be inserted into and received by the nozzle holders 270. Additionally, the outer diameter of the tubing 440 is greater than the inner diameter of the aperture 275 of the nozzle holders 270 to prevent the tubing 440 from being inserted into the aperture 275. For example, an end of each piece of the tubing 440 is configured to rest on the upper portion 274 of a respective one of the nozzle holders 270.

Figure 12A:
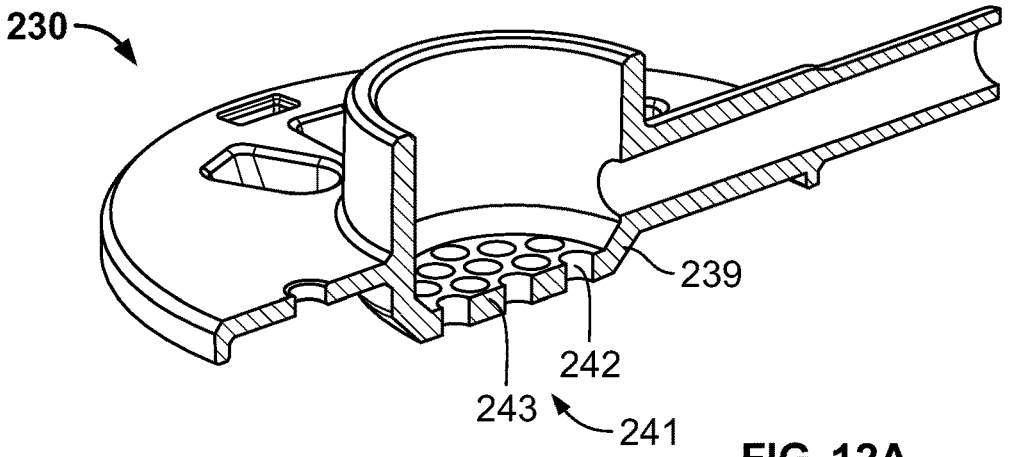
FIGS. 12A, 12B, and 12C are cross-sectional views of example flow-straightener body of the manifold of FIG. 6 in accordance with the teachings herein.
Figure 12B:
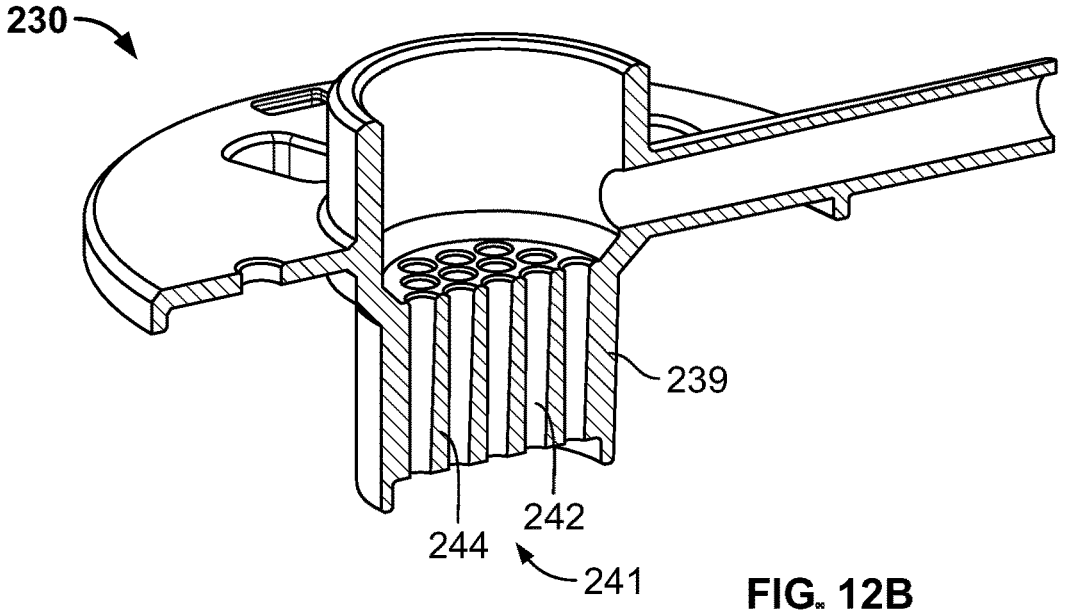
Figure 12C:
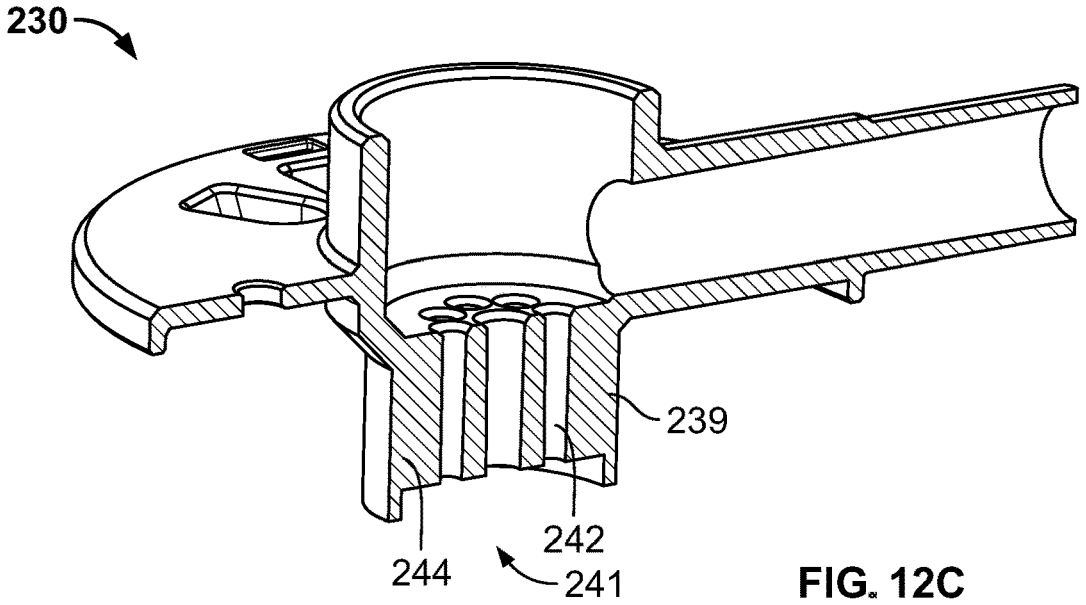

FIGS. 12A, 12B, and 12C depict respective examples of the body 230 in which the passageways 242 of the outlet 241 are defined by a component that is integrally formed with the lower portion 239 of the body 230. In FIG. 12A, the lower portion 239 of the body 230 includes a plate 243 that is integrally formed with the other portions of the body 230. The plate 243 defines a grid of the passageways 242 of the outlet 241 of the body 230. In FIGS. 12B and 12C, the lower portion 239 of the body 230 includes a block 244 that is integrally formed with the other portions of the body 230. The block 244 defines the passageways 242 of the outlet 241 of the body 230. In FIG. 12B, the block 244 defines a first pattern of the passageways 242. In FIG. 12C, the block 244 defines a second pattern of the passageways 242.

Figure 13:
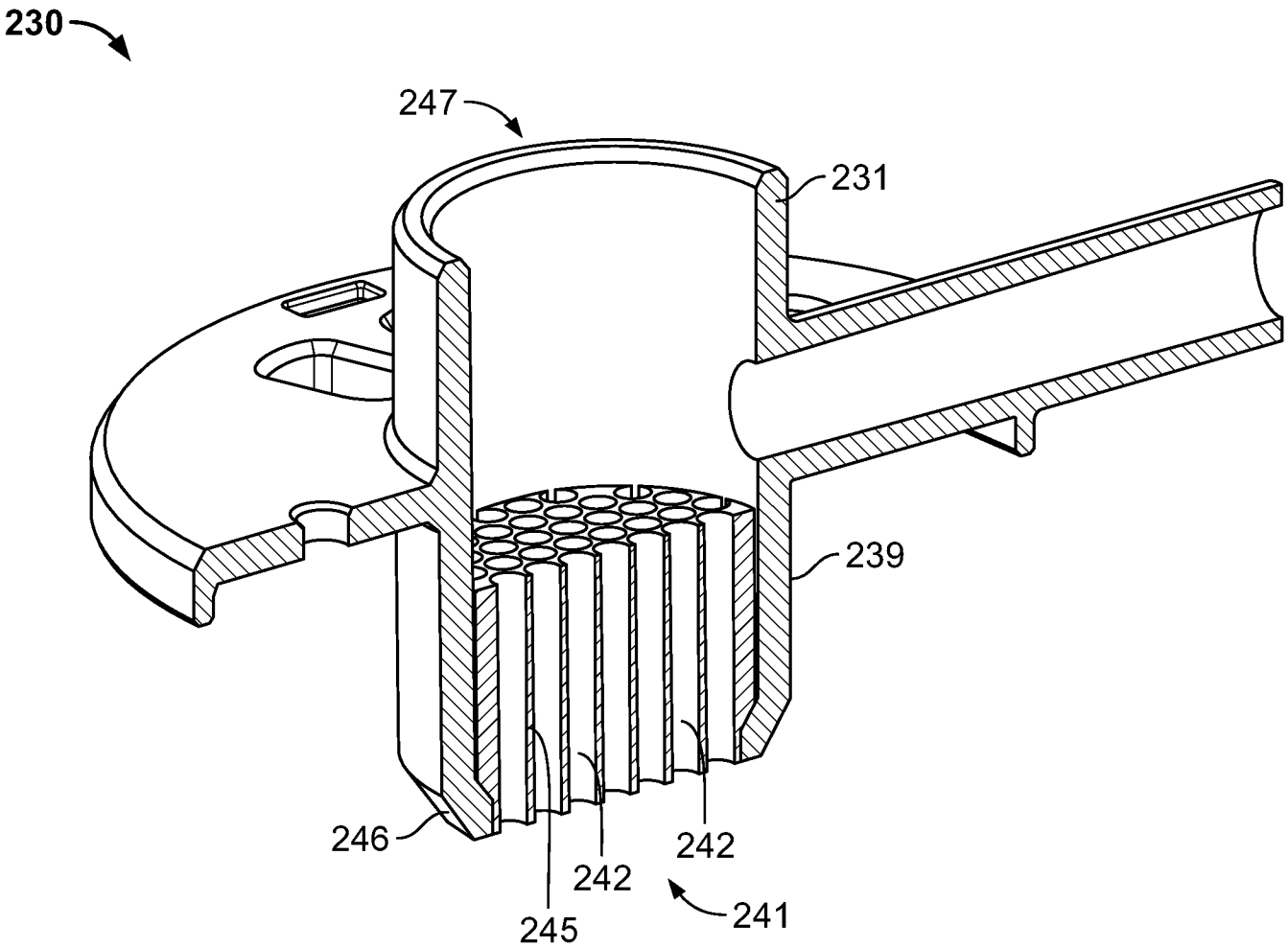
FIG. 13 is a cross-sectional view of another example flow-straightener body of the manifold of FIG. 6 that includes an insert in accordance with the teachings herein.

FIG. 13 depicts another example of the body 230 having an insert 245 that defines the passageways 242 of the outlet 241 of the body 230. The insert 245 is configured to be detachably coupled to the lower portion 239 of the body 230 of the manifold 200. The insert 245 is coupled to the body 230 to form a flow-straightener assembly of the manifold 200. In the illustrated example, a lip 246 extends inwardly from an end of the lower portion 239. The lip 246 is configured to engage the insert 245 to retain the insert 245 within the cavity 240 of the body 230.

To position the insert 245 to form the outlet 241 of the body 230, the insert 245 is configured to be inserted into the cavity 240 via an opening 247 defined by the upper portion 231 of the body 230. When removing the insert 245 from the body 230, the insert 245 is configured to be pushed and/or pulled out of the cavity 240 through the opening 247 after the cap 251 of the cover 250 has been decoupled from the upper portion 231 of the body 230. Additionally or alternatively, the insert 245 is configured to slide out of the cavity 240 upon removing the cap 251 from the upper portion 231 and turning the body 230 upside down.

FIGS. 14A, 14B, 14C, and 14D depict alternative example inserts of the body 230 of the manifold 200 in accordance with the teachings herein.

Figure 14B:
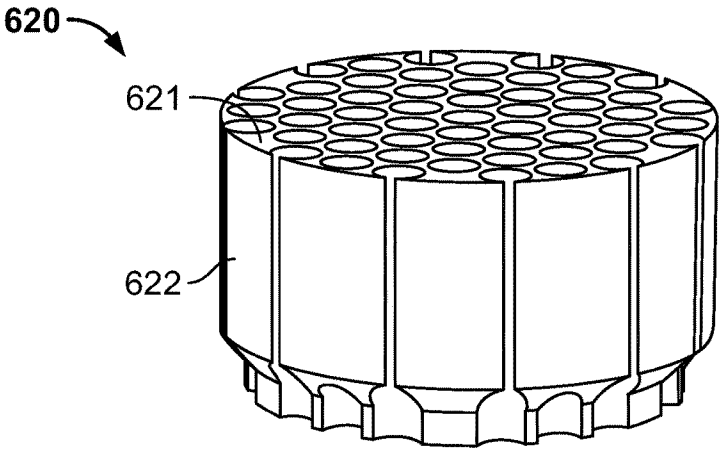
FIGS. 14A, 14B, 14C, and 14D are cross-sectional views of example inserts of the flow-straightener body of FIG. 13 in accordance with the teachings herein.
Figure 14D:
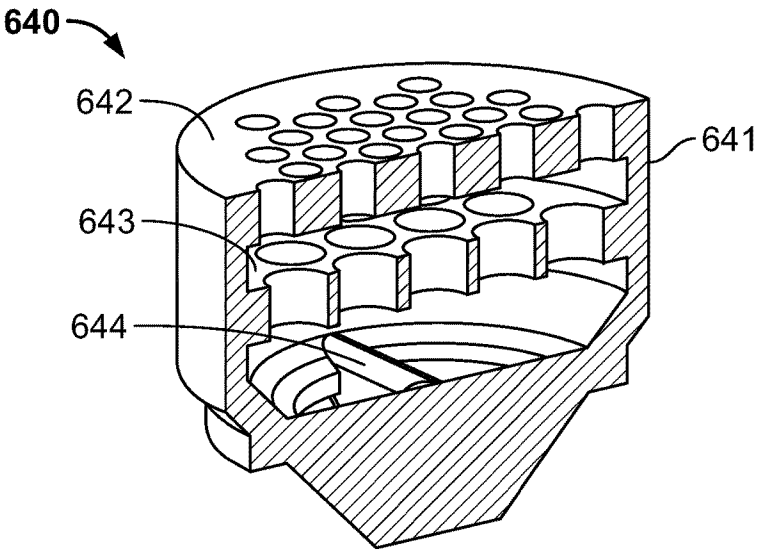
Figure 14A:
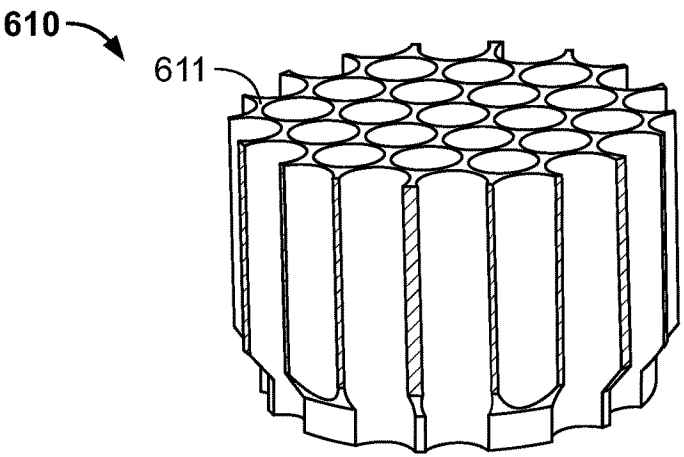

FIG. 14A depicts an example insert 610. A body 611 of the insert 610 defines the passageways 242 of the outlet 241. In FIG. 14A, the body 611 does not includes a circumferentially-extending outer wall.

FIG. 14B depicts another example insert 620. A body 621 of the insert 620 defines the passageways 242 of the outlet 241. The body 621 includes an outer wall 622 that extends circumferentially about the body 621 of the insert 620.

Figure 14C:
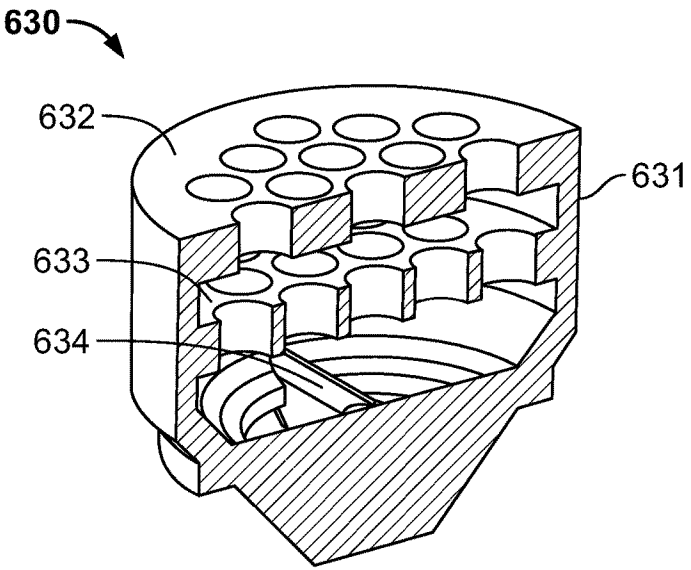
Figure 15:
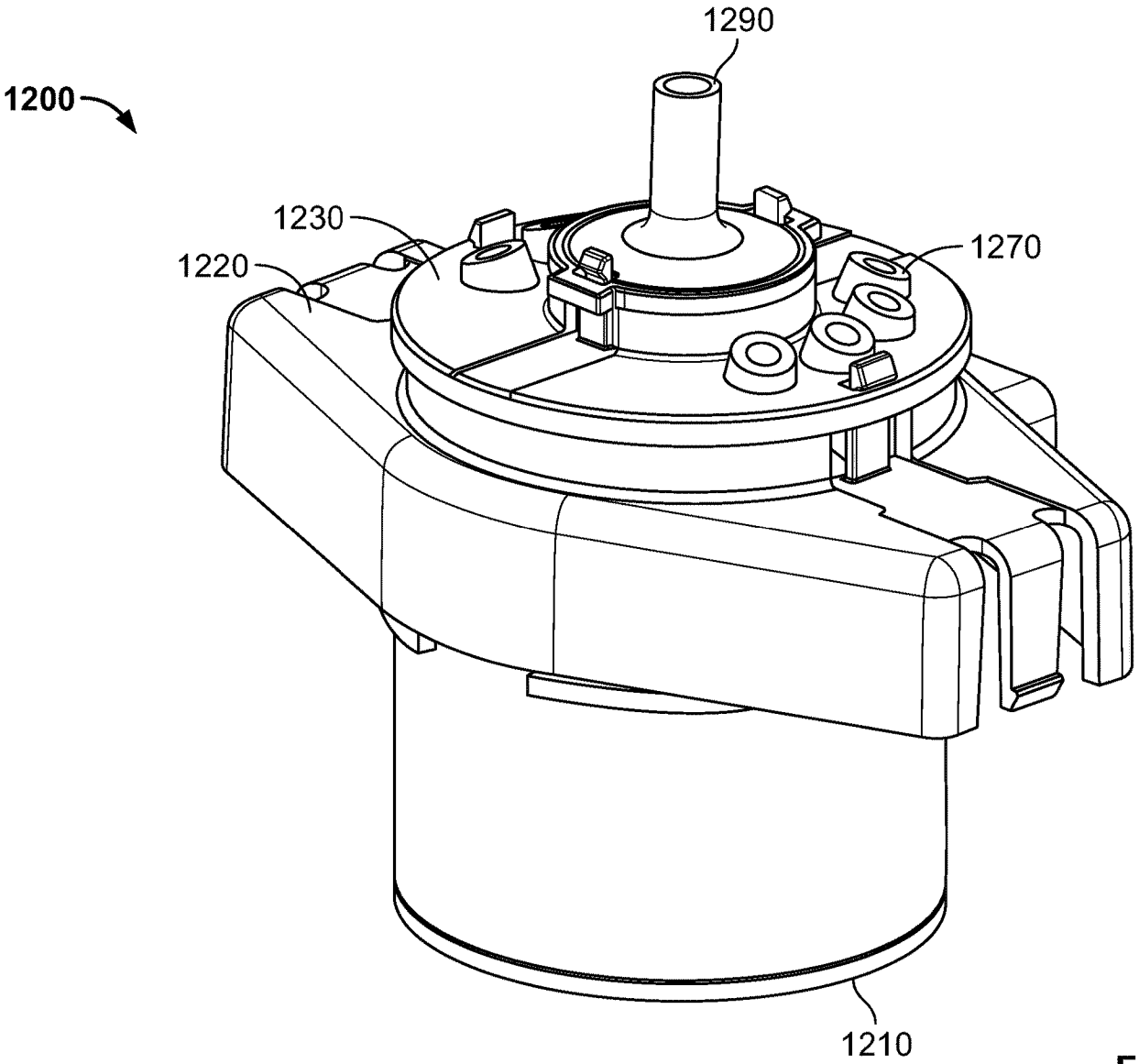
FIG. 15 illustrates another example manifold of the beverage dispenser in accordance with the teachings herein.

FIG. 14C depicts another example insert 630 that includes a first plate 632 and a second plate 633 that are arranged with respect to each other in a stacked configuration. Each of the plates 632, 633 are integrally formed with an outer wall 631 of the insert 630. Each of the plates 632, 633 also defines a respective set of openings. That is, the first plate 632 defines a first set of openings that are stacked above a second set of openings defined by the second plate 633. In the illustrated example, the grid of openings defined by the first plate 632 is identical or substantially identical to the grid of openings defined by the second plate 633. Additionally, a grate 634 (e.g., an x-shaped grate) that is integrally formed with the outer wall 631 and is located below both of the plates 632, 633. As illustrated in FIG. 14C, the grate 644 defines one or more openings for fluid flow. The passageways 242 of the outlet 241 of the body 230 are defined by a combination of the openings defined by the first plate 632, the second plate 633, and the grate 634.

FIG. 14D depicts another example insert 640 that includes a first plate 642 and a second plate 643 that are arranged with respect to each other in a stacked configuration. Each of the plates 642, 643 are integrally formed with an outer wall 641 of the insert 640. Each of the plates 642, 643 also defines a respective set of openings. That is, the first plate 642 defines a first set of openings that are stacked above a second set of openings defined by the second plate 643. In the illustrated example, the grid of openings defined by the first plate 642 is different than the grid of openings defined by the second plate 633 such that the openings of the first set are sized, oriented, and/or arranged differently than the openings of the second set. For example, the openings defined by the first plate 642 are smaller than the openings of the second plate 643. Additionally, a grate 644 (e.g., an x-shaped grate) that is integrally formed with the outer wall 641 and is located below both of the plates 642, 643. The grate 644 defines one or more openings for fluid flow. The passageways 242 of the outlet 241 of the body 230 are defined by a combination of the openings defined by the first plate 642, the second plate 643, and the grate 644.

The manifold 200 of the illustrated example is configured to facilitate an easy cleaning process. For example, (i) the body 230 is configured to be decoupled from the housing 220, (ii) the flavor nozzles 260 are configured to be decoupled from the nozzle holders 270, (iii) the nozzle holders 270 are configured to be decoupled from the body 230, (iv) the cap 251 of the cover 250 is configured to be decoupled from the body 230, and (v) the housing 220 and the base 210 are configured to be decoupled from each other and the outer wall 280 of the beverage dispenser 100 easily without tools and/or specialized training to facilitate a person in quickly and thoroughly cleaning each of the components of the manifold 200. Additionally, each of the components of the manifold 200 are configured to be quickly reassembled without tools and/or specialized training to reduce cleaning time associated with the manifold 200.

The manifold 200 of the illustrated example also is configured to prevent and/or otherwise reduce an amount of additives that contacts any surface of the manifold 200 while the beverage is dispensed in order to reduce how frequently the manifold 200 needs to be cleaned. For example, the manifold 200 is configured to position each of the flavor nozzles 260 at an angle and orientation such that fluid emitted by flavor nozzles 260 does not touch an inner surface of the manifold 200 as the beverage is dispensed. Additionally, other components, such as the flavor nozzles 260, the pouches 300, the probes 340, the pumps 400, the tubing 430, and the tubing 440 are configured to be single use articles that are recycled or thrown away and replaced without cleaning. The flavor nozzles 260 are formed of material, such as stainless steel, that reduces the frequency at which the flavor nozzles 260 are to be replaced.

FIG. 15-20B illustrates another example manifold 1200 of the beverage dispenser 100 in accordance with the teachings herein. The manifold 1200 of the illustrated example includes abase 1210, a housing 1220, a body 1230, an insert 1245, nozzle holders 1270, and an insert housing 1290. Further, as depicted in FIGS. 18-20B, the manifold 1200 is configured to house one or more flavor nozzles 1260.

The base 1210, the housing 1220, the body 1230, the insert 1245, the nozzle holders 1270, and the flavor nozzles 1260 of FIGS. 15-20B are identical and/or substantially similar to the base 210, the housing 220, the body 230, the insert 245, the nozzle holders 270, and the flavor nozzles 260 of FIGS. 6-11B. Features of the housing 1220, the body 1230, the insert 1245, the nozzle holders 1270, and the flavor nozzles 1260 of the manifold 1200 are the same as the base 210, the housing 220, the body 230, the insert 245, the nozzle holders 270, and the flavor nozzles 260 of the manifold 200, respectively, unless otherwise stated below. Additionally, because those components of the manifold 200 are described in detail in connection with FIGS. 6-11B, some features of those components of the manifold 1200 are not described in further detail below with respect to FIGS. 15-20B.

In the illustrated example, the base 1210 is configured to extend through an opening defined by the outer wall 280 of the beverage dispenser 100 to enable the manifold 1200 to dispense a beverage. The housing 1220 of the manifold 1200 couples to an upper portion of the base 1210. Additionally, one or more clips 1223 (e.g., snap-fit clips) of the housing 1220 are configured to be received by one or more clip openings 1235 of the body 1230 to securely couple the body 1230 to the housing 1220. In other examples, the housing 1220 is configured to detachably couple to the body 1230 via other fastening means, such as threading and/or fasteners (e.g., threaded fasteners).

Figure 16:
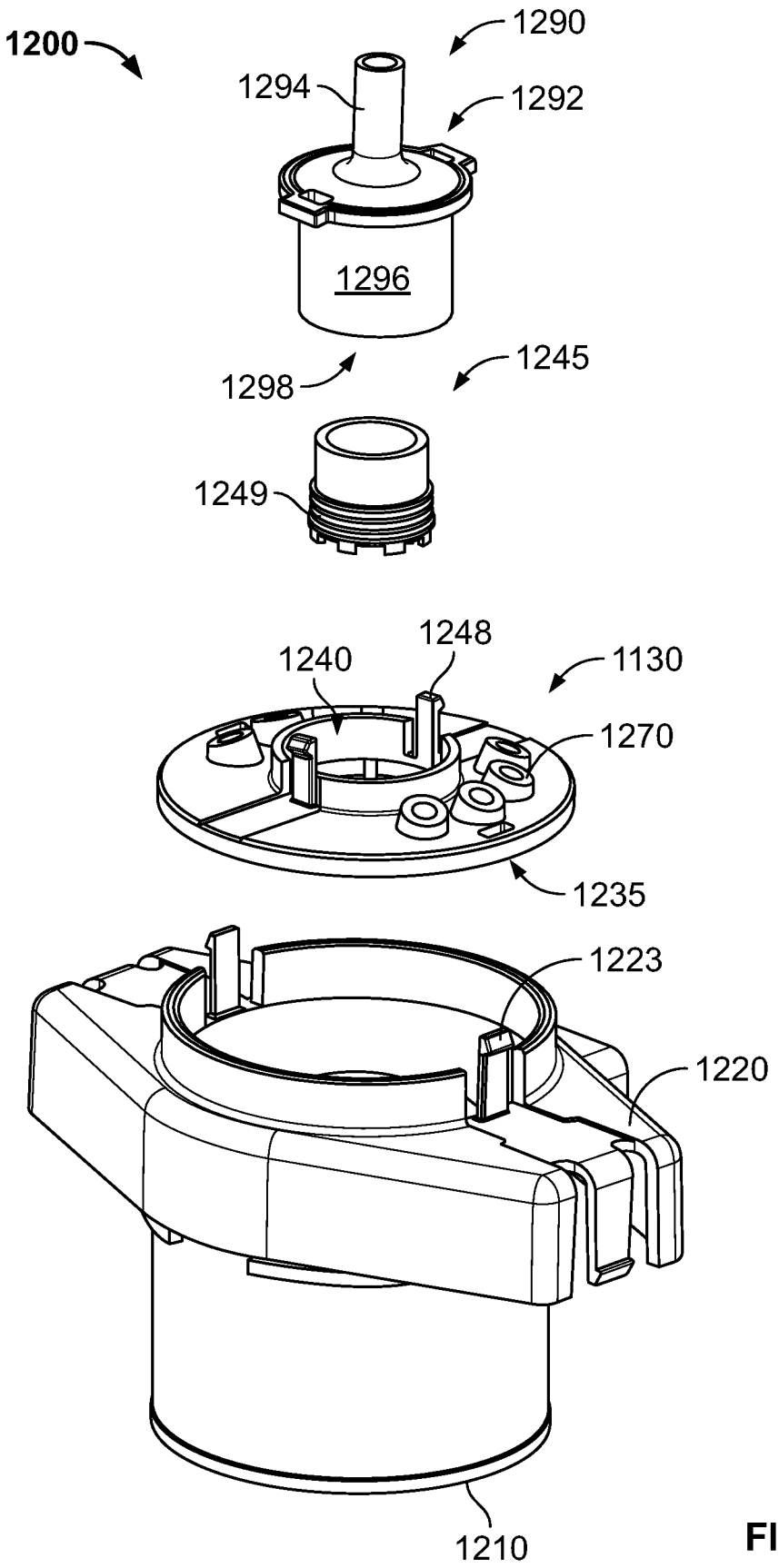
FIG. 16 is an exploded view of the manifold of FIG. 15.

In the illustrated example, the nozzle holders 1270 for the flavor nozzles 1260 are integrally formed with the body 1230. Each of the nozzle holders 1270 are uniformly oriented at a predefined angle toward a center vertical axis of the manifold 1200. As illustrated in FIG. 16, the body 1230 defines a cavity 1240 that is configured to receive the insert housing 1290. The body 1230 includes one or more clips 1248 (e.g., snap-fit clips) that are configured to be received by one or more clip openings 1292 of the insert housing 1290 to securely couple the insert housing 1290 to the body 1230. In other examples, the housing 220 is configured to detachably couple to the body 230 via other fastening means, such as threading and/or fasteners (e.g., threaded fasteners).

When coupled to the body 1230, the insert housing 1290 extends partially into the cavity 1240 of the body 1230. For example, the insert housing 1290 includes an upper portion 1294 that is to extend away from the cavity 1240 and a lower portion 1296 that is to extend into the cavity 1240. The upper portion 1294 defines an inlet 1295 configured to receive a stream of water from a pressurized chiller unit. In the illustrated example, the upper portion 1294 extends vertically along the center vertical axis of the manifold 1200. The lower portion 1296 defines a insert cavity 1298 that is configured to house the insert 1245. In the illustrated example, the lower portion 1296 includes inner threads 1299 that are configured to threadably receive outer threads 1249 of the insert 1245 to enable the insert housing 1290 to securely house the insert 1245.

Figure 17:
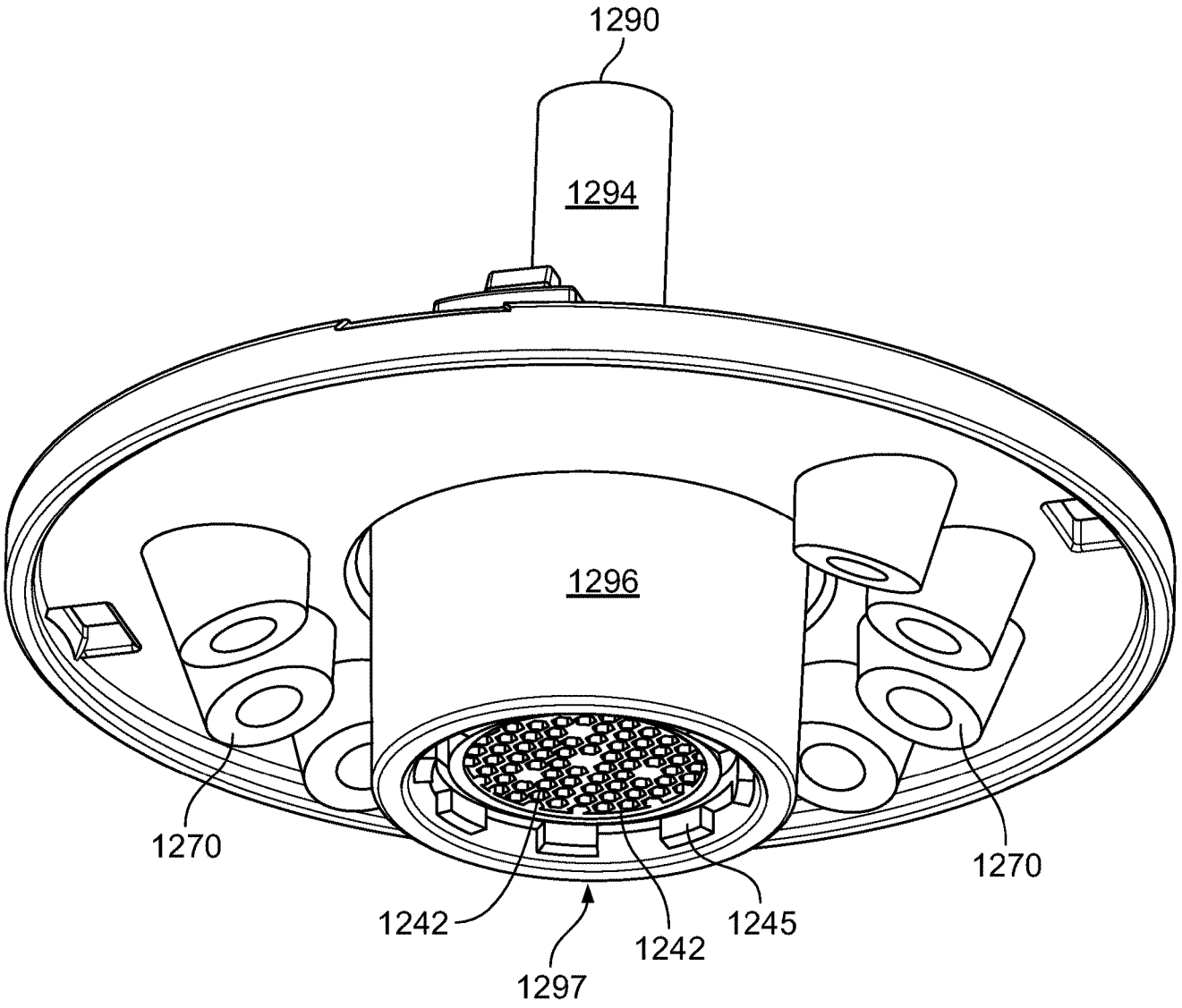
FIG. 17 illustrates an underside of the manifold of FIG. 15.
Figure 18:
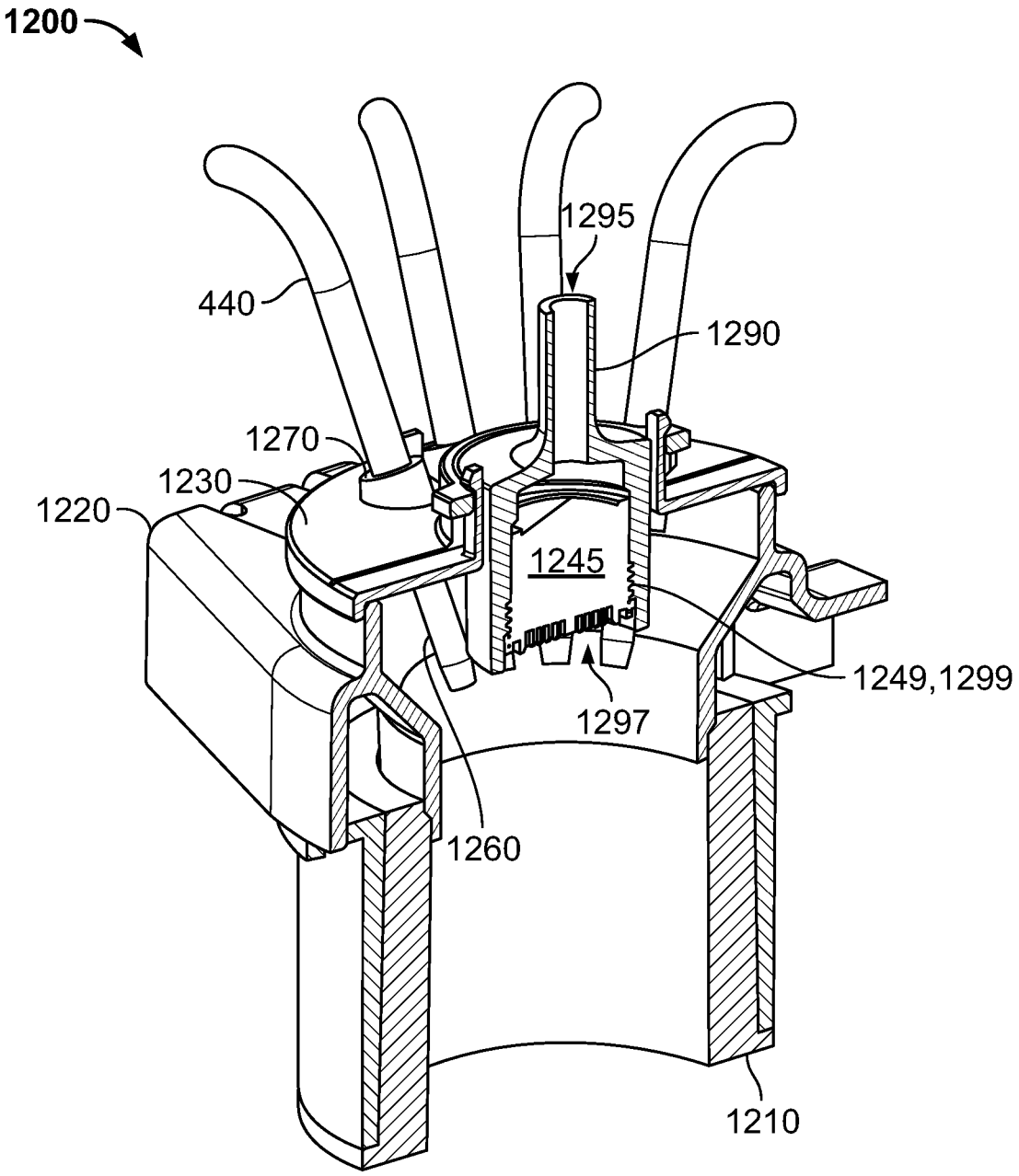
FIG. 18 is a cross-sectional view of the manifold of FIG. 15.

As illustrated in FIG. 17, the lower portion 1296 of the insert housing 1290 defines an outlet 1297 through which the stream of water from the pressurized chiller unit is emitted. Further, the inlet 1295 defines a plurality of passageways 1242 through which fluid is configured to flow in a straight, vertical manner. In turn, when the insert 1245 is securely housed in the insert housing 1290, the water stream from the pressurized chiller unit flows into the inlet 1295, through the passageways 1242 of the insert 1245, and out of the outlet 1297 in a straightened flow path. That is, the body 1230, the insert housing 1290, and the insert 1245 form a flow-straightener assembly of the manifold 1200.

Figure 19:
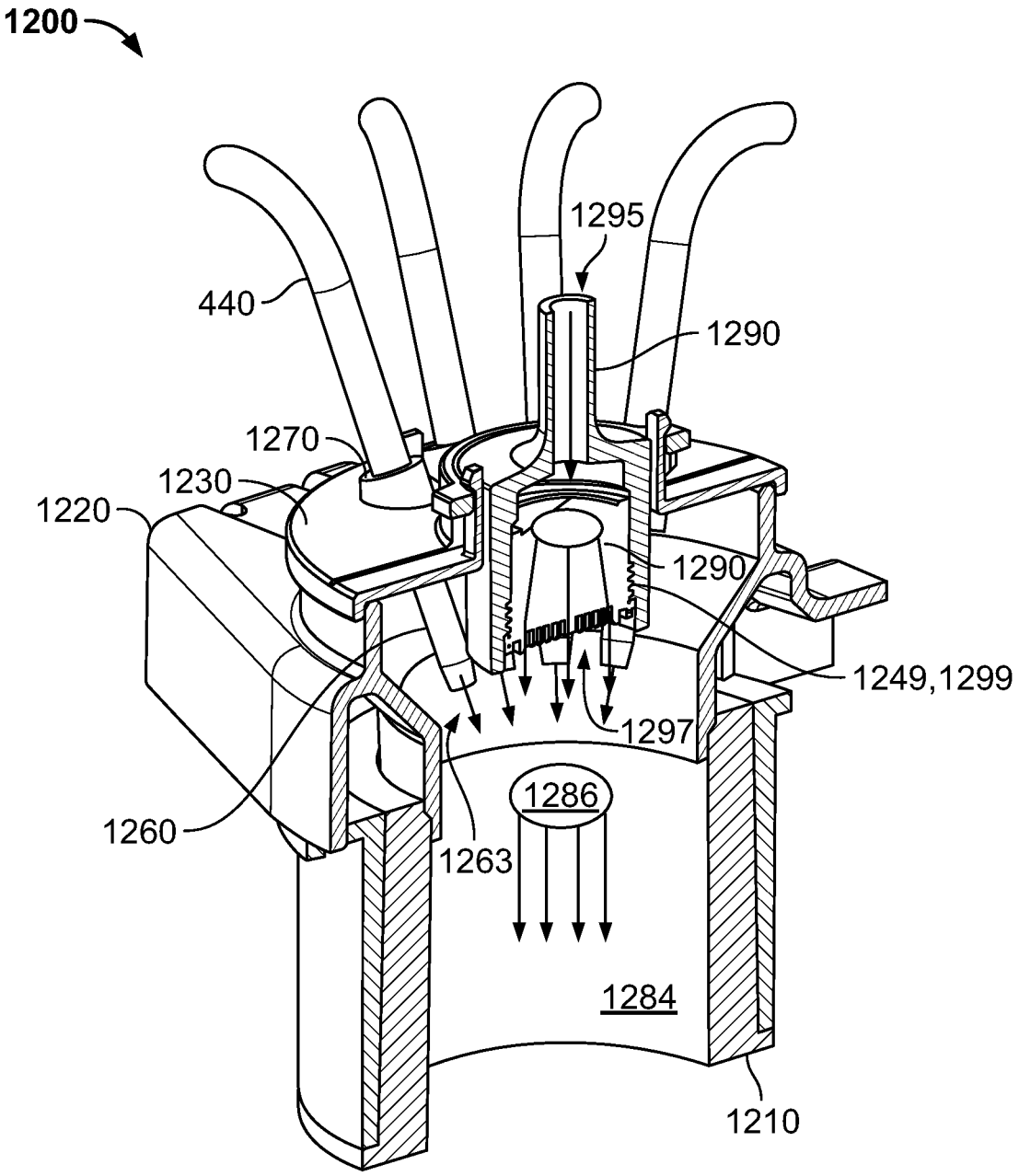
FIG. 19 is another cross-sectional view of the manifold of FIG. 15 that depicts fluid flow through the manifold.
Figure 20B:
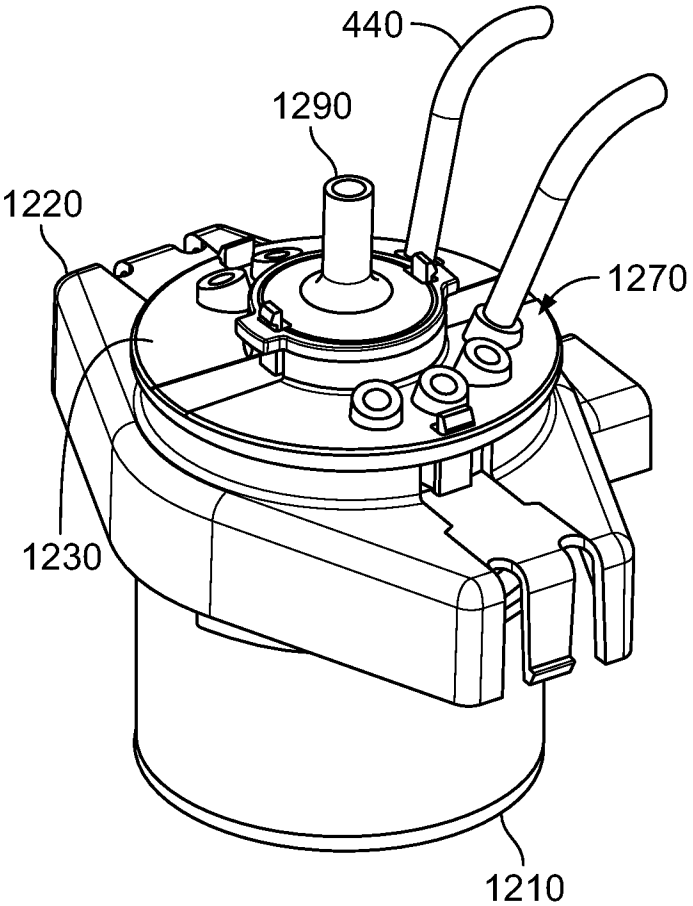
FIGS. 20A and 20B depict flavor nozzles being positioned within the manifold of FIG. 15.
Figure 20A:
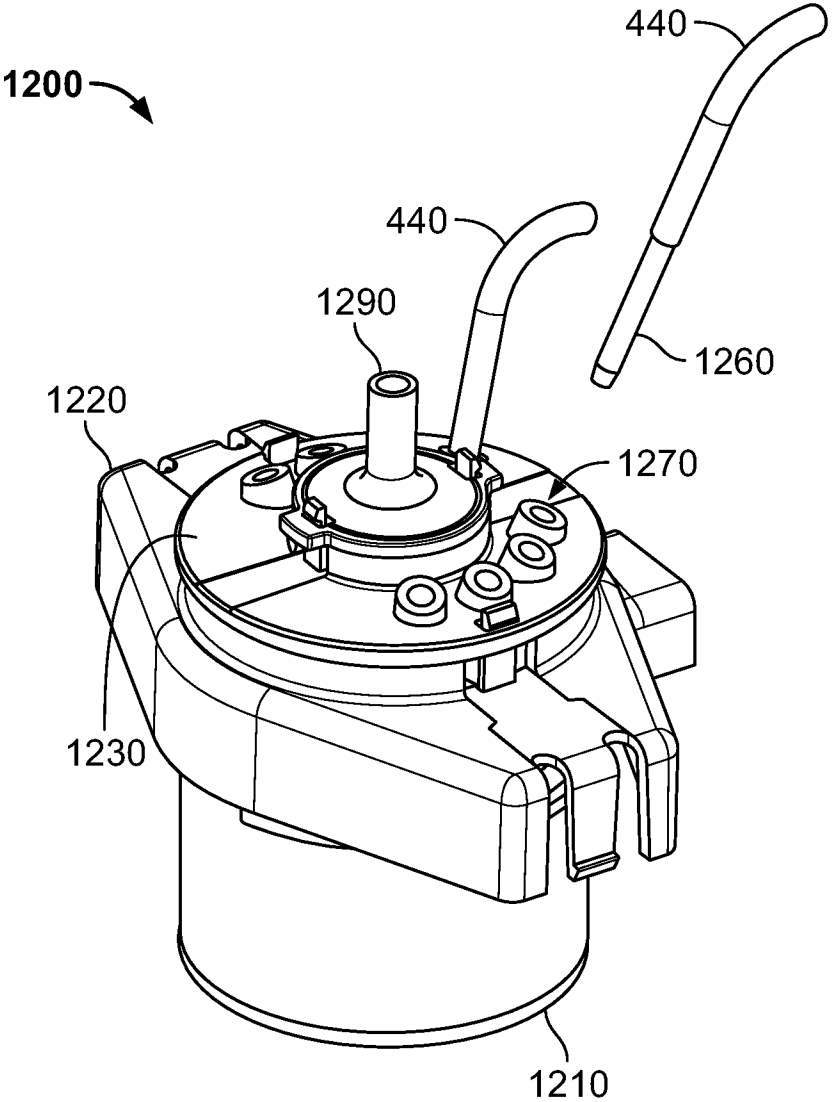

As illustrated in FIG. 19, the water stream emitted by the flow-straightener assembly then mixes with one or more flavor/additive(s) that are emitted by respective one(s) of the flavor nozzles 1260. The flavor/additive(s) are emitted out of outlets 1263 of the flavor nozzles 1260. Each of the flavor nozzles 1260 is configured to spray a respective flavor/additive at a predefined injection angle (e.g., a 20-degree angle formed between the water stream and the flavor/additive stream) such that the flavor/additive is injected into the water stream at a mid-air injection point 1286, which is located within a chamber 284 formed by the base 1210 and/or the housing 1220, without contacting a surface of the manifold 200. The mixture of the water and the flavor/additive(s) is subsequently dispensed from the manifold 1200 in a substantially vertical direction into a container located within the dispensing area 134 of the beverage dispenser 100. That is, the manifold 200 is configured to separate flavor/additive flow components and water flow components until right before the flavor/additive(s) are mixed with the water to maintain the cleanliness of the manifold 200.

The manifold 1200 of FIGS. 15-20B is configured to facilitate an easy cleaning process without requiring tools and/or specialized training. For example, (i) the body 1230 is configured to be decoupled from the housing 1220, (ii) the insert housing 1290 is configured to be decoupled from the body 1230, (iii) the insert 1245 is configured to be decoupled from the insert housing 1290, (iv) the cap 251 of the cover 250 is configured to be decoupled from the body 230, and (v) the housing 1220 and the base 1210 are configured to be decoupled from each other and the outer wall 280 of the beverage dispenser 100 easily without tools and/or specialized training to facilitate a person in quickly and thoroughly cleaning each of the components of the manifold 200. Additionally, each of the components of the manifold 1200 are configured to be quickly reassembled without tools and/or specialized training to reduce cleaning time associated with the manifold 1200.

The manifold 1200 also is configured to prevent and/or otherwise reduce an amount additives that contacts any surface of the manifold 1200 while the beverage is dispensed in order to reduce how frequently the manifold 1200 needs to be cleaned. For example, the manifold 1200 is configured to position each of the flavor nozzles 1260 at an angle and orientation such that fluid emitted by flavor nozzles 1260 does not touch an inner surface of the manifold 200 as the beverage is dispensed. Additionally, other components, such as the flavor nozzles 1260, are configured to be single use articles that are recycled or thrown away and replaced without cleaning. The flavor nozzles 1260 are formed of material, such as stainless steel, that reduces the frequency at which the flavor nozzles 260 are to be replaced.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A manifold of a beverage dispenser for dispensing a beverage into a container, the manifold comprising:

a base defining a base cavity and configured to extend through an opening defined by an outer wall of the beverage dispenser;

a first housing coupled to the base and defining a housing cavity, wherein the base cavity and the housing cavity are adjacent to each other to form a chamber;

a body coupled to the first housing and defining a body cavity and angled apertures, wherein the angled apertures are spaced radially outward from the body cavity and oriented radially inward at a predefined angle;

an insert housing that is coupled to the body and extends at least partially through the body cavity, wherein the insert housing defines a water inlet; and an insert housed within the insert housing and defining a water outlet configured to spray a water stream vertically downward into the chamber, wherein the angled apertures are configured to receive nozzles that extend at least partially into the chamber at the predefined angle relative to a vertical axis such that flavor or additive emitted by one or more of the nozzles is injected into the water stream at a mid-air injection point within the chamber.

2. The manifold of claim 1, wherein the mid-air injection point within the chamber is spaced apart from surfaces of the base, the first housing, the body, the insert housing, and the insert to reduce how frequently the manifold is to be cleaned.

3. The manifold of claim 1, wherein the base, the first housing, the body, the insert housing, and the insert are configured to decouple from each other without tooling to facilitate cleaning of the manifold.

4. The manifold of claim 3, wherein the base includes a circumferential lip configured to rest on the outer wall of the beverage dispenser.

5. The manifold of claim 3, wherein the first housing includes first clips for fastening the first housing to the outer wall of the beverage dispenser.

6. The manifold of claim 3, wherein the body further defines clip openings and the first housing includes clips that extend through the clip openings to couple the body to the first housing.

7. The manifold of claim 3, wherein the insert is threadably coupled to the insert housing.

8. The manifold of claim 3, wherein the insert housing includes clips openings and the body includes clips that extend through the clip openings to couple the insert housing to the body.

9. The manifold of claim 1, wherein the insert defines a plurality of passageways that form the water outlet, wherein the plurality of the passageways create a uniform water flow with reduced pressure to facilitate subsequent mixture with flavor or additive emitted by the nozzles.

10. The manifold of claim 1, wherein the insert housing includes an upper portion and a lower portion.

11. The manifold of claim 10, wherein the upper portion defines the water inlet.

12. The manifold of claim 10, wherein the lower portion defines an insert cavity in which the insert is housed.

13. The manifold of claim 10, wherein the lower portion includes inner threads, the insert includes outer threads, and the inner threads are configured to threadably receive the outer threads to couple the insert to the insert housing.

14. A method for operating and maintaining a manifold of a beverage dispenser that dispenses a beverage into a container, the method comprising:

positioning a base to extend through an opening defined by an outer wall of the beverage dispenser, the base defining a base cavity;

coupling a first housing to the base such that a housing cavity defined by the housing cavity is positioned adjacent to the base cavity to form a chamber;

coupling a body to the first housing, the body defining a body cavity and angled apertures, the angled apertures being spaced radially outward from the body cavity and oriented radially inward at a predefined angle;

housing an insert within an insert housing, the insert defining a water outlet, the insert housing defining a water inlet;

positioning the insert housing at least partially through the body cavity;

coupling the insert housing to the body such that the water outlet is configured to spray a water stream downward into the chamber;

extending nozzles through the angled apertures such that the nozzles extend at least partially into the chamber at the predefined angle relative to a vertical axis; and injecting flavor or additive via one or more of the nozzles into the water stream at a mid-air injection point within the chamber.

15. The method of claim 14, further comprising:

decoupling the base, the first housing, the body, the insert housing, and the insert from each other without tooling; and cleaning the base, the first housing, the body, the insert housing, and the insert of the manifold.

16. The method of claim 14, further comprising resting a circumferential lip of the base on the outer wall of the beverage dispenser.

17. The method of claim 14, further comprising fastening the first housing to the outer wall of the beverage dispenser via clips of the first housing.

18. The method of claim 14, wherein coupling the body to the first housing includes extending clips through clip openings.

19. The method of claim 14, further comprising threadably coupling the insert to the insert housing.

20. The method of claim 14, wherein coupling the insert housing to the body includes extending clips through clip openings.

* * * * *